US007335151B2

(12) United States Patent
Toth

(10) Patent No.: US 7,335,151 B2
(45) Date of Patent: Feb. 26, 2008

(54) METHOD, APPARATUS AND SYSTEM FOR MAKING CUSHIONING PRODUCT, AND ROLL TENSIONER THEREFOR

(75) Inventor: Zsolt Toth, Tuckahoe, NY (US)

(73) Assignee: Zsolt Design Engineering, Inc., Tuckahoe, NY (US)

( * ) Notice: Subject to any disclaimer, the term of this patent is extended or adjusted under 35 U.S.C. 154(b) by 0 days.

(21) Appl. No.: 11/337,692

(22) Filed: Jan. 24, 2006

(65) Prior Publication Data

US 2006/0135336 A1 Jun. 22, 2006

Related U.S. Application Data

(60) Division of application No. 10/321,458, filed on Dec. 18, 2002, now Pat. No. 7,022,060, which is a continuation-in-part of application No. 10/208,772, filed on Aug. 1, 2002, now Pat. No. 6,673,001, which is a continuation-in-part of application No. 09/819,998, filed on Mar. 29, 2001, now Pat. No. 6,503,182.

(51) Int. Cl.
*B31B 1/02* (2006.01)
*B31B 1/14* (2006.01)

(52) U.S. Cl. ..... 493/464; 493/967

(58) Field of Classification Search ..... 493/395, 493/464, 967; 53/430, 452; 248/646, 662, 248/670; 242/533.3, 534, 563, 595, 595.1
See application file for complete search history.

(56) References Cited

U.S. PATENT DOCUMENTS

| | | | | |
|---|---|---|---|---|
| 673,312 | A | 4/1901 | Bechman | 493/370 |
| 803,972 | A | 11/1905 | Bechman | 493/370 |
| 1,739,328 | A | 12/1929 | Roesen | 493/370 |
| 2,786,399 | A | 3/1957 | Mason et al. | 493/967 |
| 2,953,821 | A | 9/1960 | Ingham, Jr. | 242/595.1 |
| 3,473,291 | A | 10/1969 | Raumond et al. | 53/530 |
| 3,603,216 | A | 9/1971 | Johnson | 493/967 |
| 3,744,360 | A | 7/1973 | Currie et al. | 83/23 |
| 3,799,039 | A | 3/1974 | Johnson | 493/967 |
| 3,920,136 | A | 11/1975 | Talbert | 242/595 |
| 4,052,920 | A | 10/1977 | Dixon | 83/337 |
| 4,355,493 | A | 10/1982 | Ellert | 53/530 |
| 4,750,896 | A | 6/1988 | Komaransky et al. | 493/967 |
| 4,999,968 | A | 3/1991 | Davis | 493/238 |
| 5,076,555 | A | 12/1991 | Bunch, Jr. | 493/415 |
| 5,131,903 | A | 7/1992 | Levine et al. | 493/464 |
| 5,203,761 | A | 4/1993 | Reichental et al. | 493/967 |
| 5,257,492 | A | 11/1993 | Watts | 53/430 |
| 5,326,041 | A | 7/1994 | Alexander et al. | 242/595.1 |
| 5,643,647 | A | 7/1997 | Wischusen, III | |
| 5,730,696 | A | 3/1998 | Simmons | 493/967 |
| 5,749,539 | A | 5/1998 | Ratzel et al. | |

(Continued)

*Primary Examiner*—Louis Huynh
(74) *Attorney, Agent, or Firm*—Antonelli, Terry, Stout & Kraus, LLP.

(57) ABSTRACT

A method, apparatus and system for making cushioning product, and a roll tensioner therefor apply frictional resistance to the periphery of a roll of material to be converted into cushioning product with at least one roll support member which supports the roll in addition to applying frictional resistance to rotation. Efficient operation is attained automatically in that the frictional resistance applied and also the pulling profile exerted on the material during unwinding of the roll are changed as a function of weight and/or other characteristics of the roll of material to be converted into cushioning product.

9 Claims, 24 Drawing Sheets

U.S. PATENT DOCUMENTS

| | | | | |
|---|---|---|---|---|
| 5,755,656 | A | 5/1998 | Beierlorzer | 493/967 |
| 5,785,639 | A | 7/1998 | Simmons | |
| 5,902,223 | A | 5/1999 | Simmons | 493/967 |
| 5,938,580 | A | 8/1999 | Siekmann | |
| 5,971,348 | A | 10/1999 | Thomas | 248/662 |
| 6,033,353 | A | 3/2000 | Lencoski et al. | 493/464 |
| 6,146,321 | A | 11/2000 | Simmons | 493/967 |
| 6,161,792 | A | 12/2000 | Kayser | 242/595.1 |
| 6,179,765 | B1 | 1/2001 | Toth | |
| 6,196,492 | B1 | 3/2001 | Baumeister | 242/533.3 |
| 6,200,251 | B1 | 3/2001 | Harding et al. | 493/464 |
| 6,209,817 | B1 | 4/2001 | Conrad et al. | 242/534 |
| 6,217,501 | B1 | 4/2001 | Simmons et al. | 493/967 |
| 6,240,705 | B1 | 6/2001 | Simmons et al. | 493/967 |
| 6,277,459 | B1 | 8/2001 | Lencoski et al. | 493/967 |
| 6,471,154 | B1 | 10/2002 | Toth | |
| 6,503,182 | B2 | 1/2003 | Toth | 493/238 |
| 7,089,714 | B2 * | 8/2006 | Thomas | 53/452 |

* cited by examiner

METHOD, APPARATUS AND SYSTEM FOR MAKING CUSHIONING PRODUCT, AND ROLL TENSIONER THEREFOR

RELATED APPLICATIONS

This application is a divisional application of Ser. No. 10/321,458, filed Dec. 18, 2002, now U.S. Pat. No. 7,022,060 issued Apr. 4, 2006, which is a continuation-in-part of U.S. application Ser. No. 10/208,772 filed Aug. 1, 2002, now U.S. Pat. No. 6,673,001 issued Jan. 6, 2004, which in turn is a continuation-in-part of U.S. application Ser. No. 09/819,998 filed Mar. 29, 2001, now U.S. Pat. No. 6,503,182 issued Jan. 7, 2003, which applications are hereby incorporated by reference.

TECHNICAL FIELD

The invention relates to a method, an apparatus and a system, and a roll tensioner therefor, for making a cushioning product useful in the packaging industry when shipping products in boxes, for example.

BACKGROUND

Cushioning dunnage is used as a protective packaging material when shipping an item in a container. The dunnage fills any voids and/or cushions the item in the container during shipping. Typical materials for forming cushioning dunnage include paper and plastic. Relatively complicated machines and methods are known for producing cushioning dunnage comprising resilient pillow-like strips from rolls of stock material. One such known machine is disclosed in U.S. Pat. No. 5,785,639. The known machines are disadvantageous in that they are suitable primarily for larger-scale productions and they are relatively expensive. There has long been a need in the packaging industry for a small and inexpensive device that creates and dispenses paper or other material for use as void fill and cushioning when shipping products in boxes or other containers.

One common method of supplying material for making a cushioning product is to dispense the material from a roll of material by pulling the material to unwind it from the roll. U.S. Pat. No. 5,749,539 discloses a relatively complex mandrel assembly for mounting a roll of material onto a mounting frame at a supply end of a dunnage conversion machine. This prior art mandrel assembly requires a spindle which extends through the length of the roll and about which the roll rotates on plugs mounted on the roll and carried rotatably by the spindle. This known arrangement does not provide the ability to apply tension to the material roll except for whatever rotational friction is generated between the spindle, which is fixed to the mounting frame, and the plugs which rotate freely about the fixed spindle. In the absence of tension, material backlash may occur when the drive motor is stopped to cut the material.

Excess backlash can separate the material from the forming mechanism, reducing the forming and shaping capabilities of the machine, producing an unsatisfactory product. That is, the roll of material can keep turning even after the material has suddenly stopped being pulled forward which causes the material to lose tension and slacken, and extra material to hang loosely from the roll. Then when the material is quickly pulled forward again, the slack is taken out before the roll begins turning, causing the material to rip.

One proposed solution to this problem, disclosed in U.S. Pat. No. 6,179,765, is to provide jam cleats which are spring biased against mandrel handles of the mandrel assembly to apply a predetermined amount of friction against the mandrel handle. This arrangement is relatively complex and costly and does not account for variations in the necessary frictional force required for rolls of different material or weight, or for changes in the weight of the roll as the material is unwound/dispensed therefrom. There is a need for an improved roll tensioner, and an apparatus, a system and a method for making a cushioning product, which are compact, simple, low cost, and which automatically apply frictional resistance to rotation of the roll being unwound in accordance with the required frictional force for efficient operation.

SUMMARY

The present invention addresses this need. The method of making a cushioning product of the invention comprises pulling material from a roll of material which is positioned to permit the roll to be rotated about a longitudinal axis of the roll in response to the pulling to unwind material from the roll, and shaping the material pulled from the roll for converting the material into a cushioning product, wherein the material being pulled from the roll is tensioned by applying frictional resistance to rotation of the roll at the periphery of the material on the roll with at least one support member which supports the roll. In an example embodiment, the frictional resistance is applied as a function of the weight of the roll by at least one roll support member of a roll tensioner.

The efficiency of the method, and the operation of the apparatus and system for carrying it out, is enhanced according to a further feature of the invention which includes identifying a characteristic of the roll of material and adjusting an acceleration/deceleration profile of the pulling to unwind material from the roll as a function of the identified characteristic. The identifying can be performed visually by the operator or, according to example embodiments, is accomplished using a recognition device such as a scanner to detect at least one marking provided on the roll of material to indicate a characteristic of the roll of material.

The marking conveying identifying information can be in the form of at least one of a bar code, magnet, microchip, hologram, pattern or other identification. With the aid of detection of the at least one marking on the roll of material, tracking usage of material and tracking the amount of material made into cushioning product are performed with the method, apparatus and system of the invention.

These and other features and advantages of the invention will become more apparent from the following description when taken in connection with the accompanying drawings which show, for purposes of illustration only, several example embodiments in accordance with the invention.

BRIEF DESCRIPTION OF DRAWINGS

The following represents brief descriptions of the drawings, wherein.

DETAILED DESCRIPTION

Figure 1:
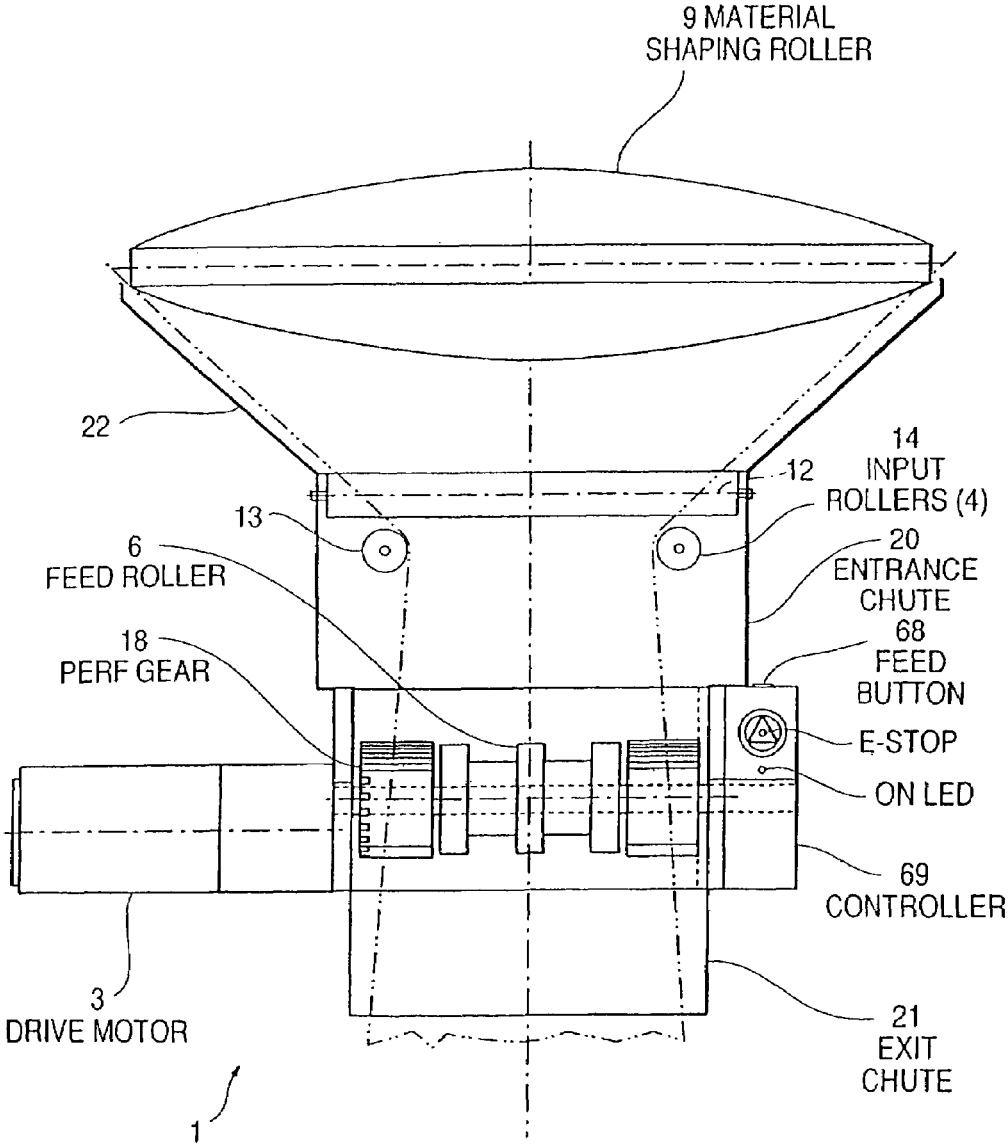
FIG. 1 is a front side view of a compact apparatus according to an example embodiment of the invention for creating and dispensing material for use of void fill and cushioning dunnage.
Figure 2:
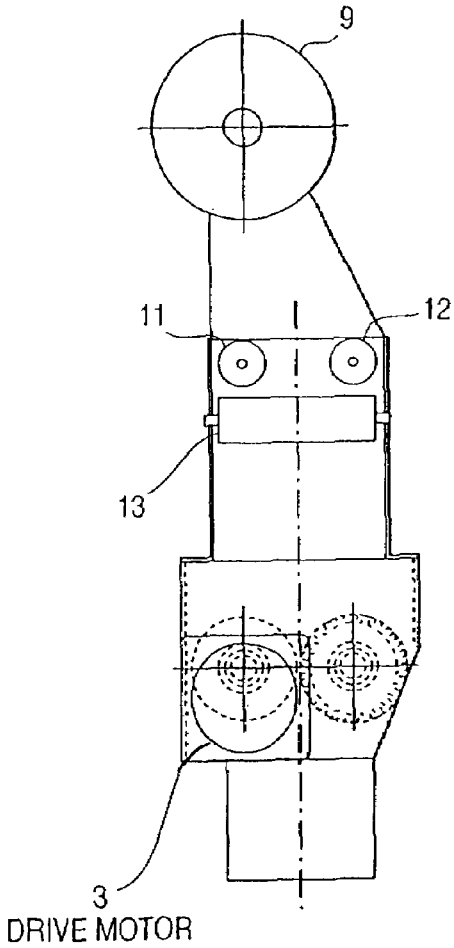
FIG. 2 is a left side view of the compact apparatus of FIG. 1.
Figure 3:
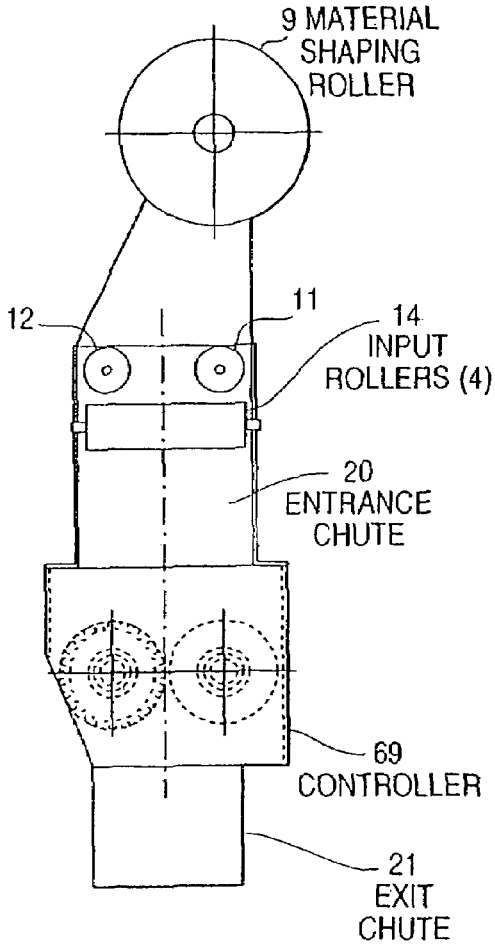
FIG. 3 is a right side view of the compact apparatus of FIG. 1.

Referring now to the drawings, a compact apparatus 1 of the invention, as shown in FIGS. 1-6, is for creating and dispensing material for use as a void fill and cushioning dunnage. The apparatus 1 is a relatively small, integral unit capable of being mounted on a stand, for example, floor stand 2 in FIG. 6. The apparatus 1 comprises a motor 3 and a material feeding arrangement 4, FIG. 4, driven by the motor for pulling material from a supply of material, e.g., a material roll 5 in FIG. 6, and feeding it through the apparatus.

Figure 4:
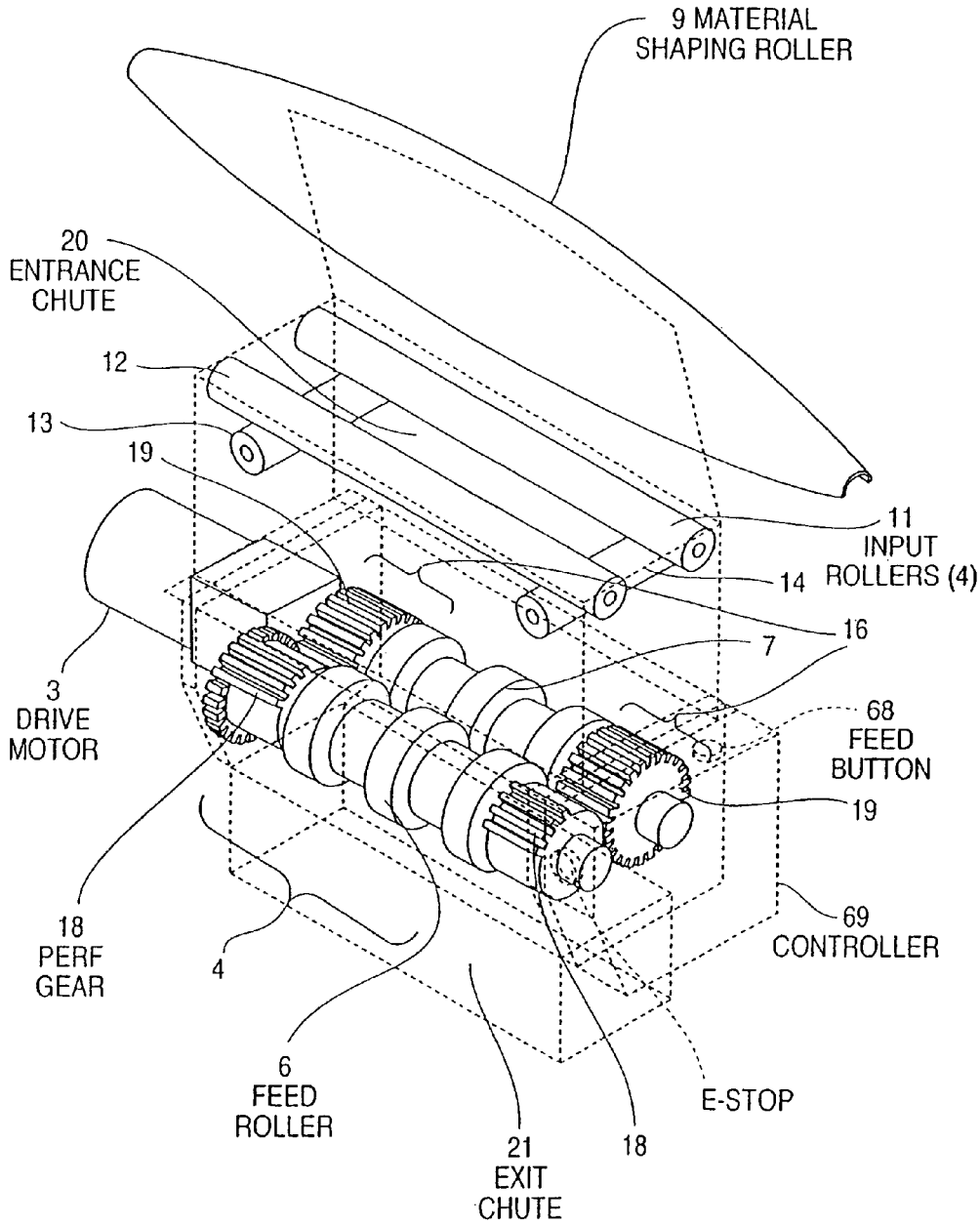
FIG. 4 is a schematic drawing of functional components of the compact apparatus of FIGS. 1-3 more clearly showing the components.
Figure 5:
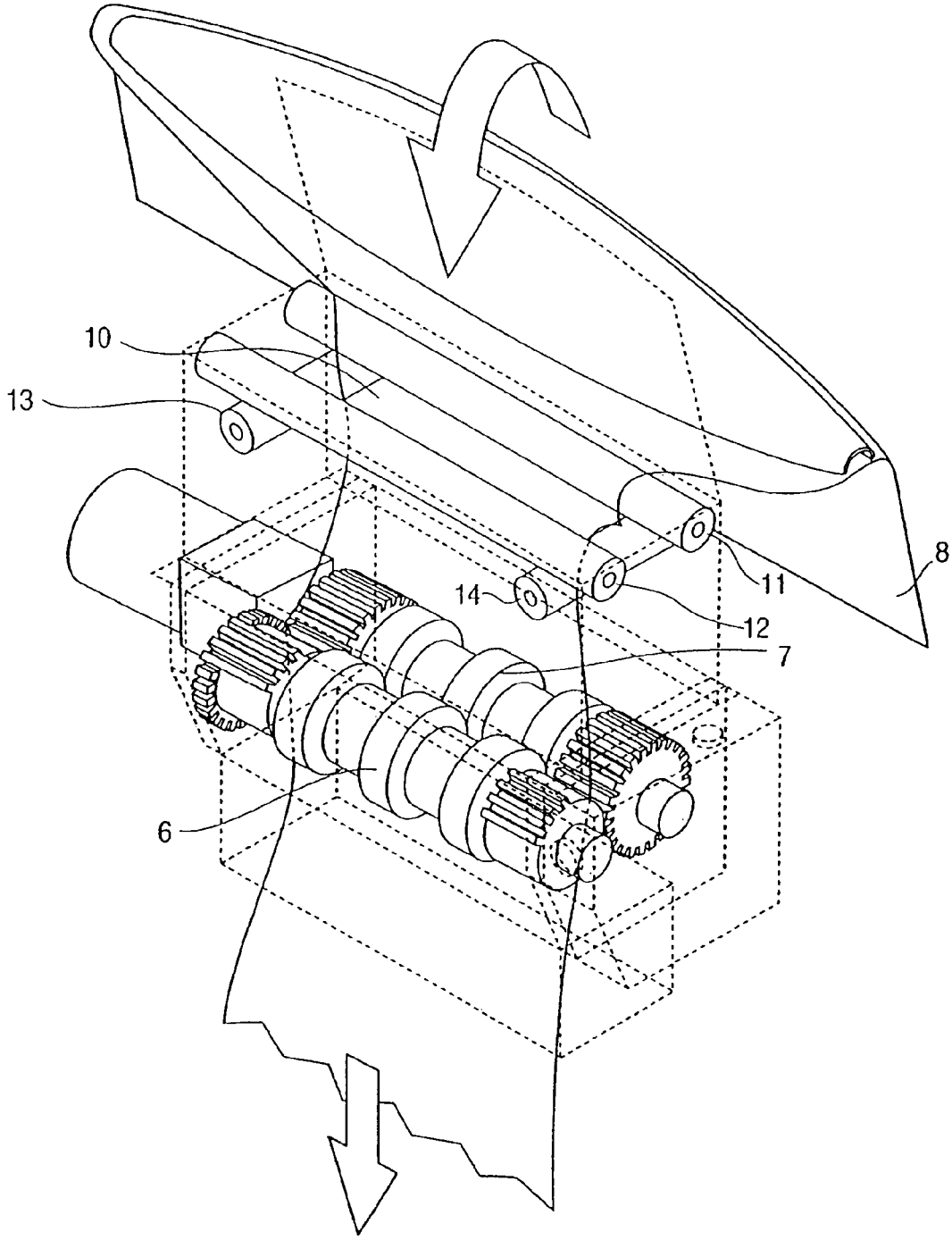
FIG. 5 is a schematic drawing like FIG. 4 showing the apparatus functional components in relation to a paper material being pulled into the apparatus from a supply roll of the paper and fed through the apparatus while being converted into a cushioning product.

The material feeding arrangement 4 comprises cooperating feed rollers 6 and 7, see FIG. 4, between which the material 8, paper in the example embodiment, is fed as depicted in FIG. 5. A plurality of material shaping members upstream of the material feeding arrangement 4 shape the material 8 into a continuous strip of cushioning product as the material is fed through the apparatus 1. The material shaping members include a convex material shaping roller 9 over which the material 8 is drawn by the feed rollers 6 and 7.

Figure 7A:
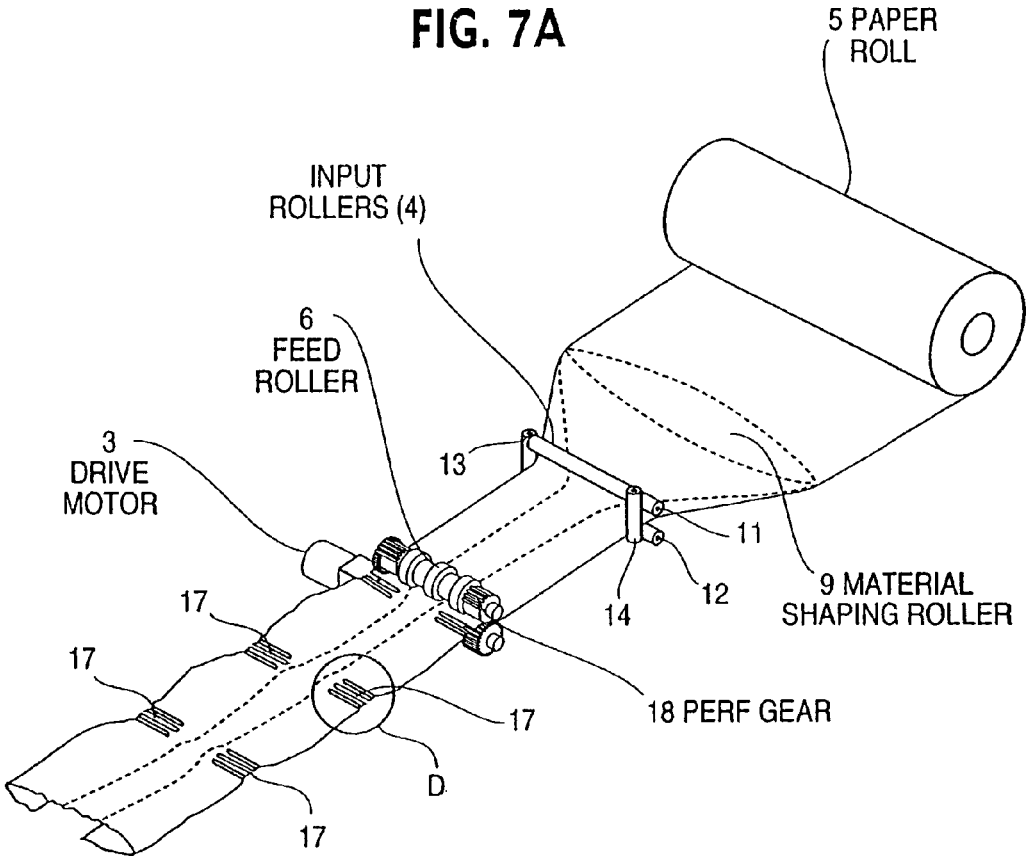
FIG. 7A is a view similar to FIG. 5 but showing more details of the pillow-like product formed by the apparatus with spaced perforations along the length of the product enabling an operator to tear off in a predictable way a desired length of the material from the continuous strip dispensed from the apparatus.
Figure 7B:
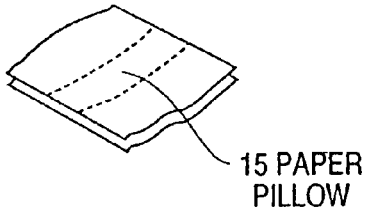
FIG. 7B is a perspective view from above and to one side of a paper pillow which has been ripped from the free end of the continuous cushioning product shown in FIG. 7A.
Figure 7C:
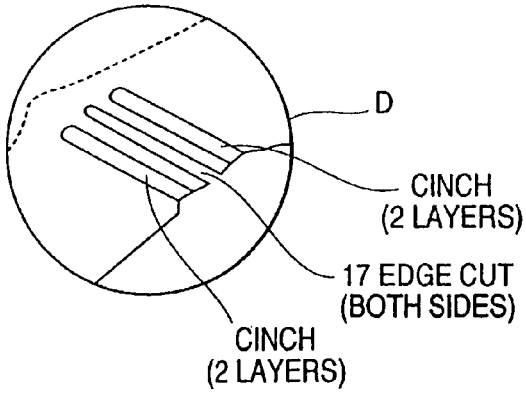
FIG. 7C is an enlarged view of the portion of the cushioning product within the circle D in FIG. 7A, illustrating a perforated area along one edge of the cushioning product.

An input opening 10 for the material 8 downstream of the convex roller 9 is defined by first and second pairs of spaced, parallel rollers 11, 12 and 13, 14. The second pair of rollers 13, 14 extend in a direction transverse to that of the first pair of rollers 11, 12. When the material 8 is drawn over the convex roller 9, the lateral edges of the material are directed in a first direction over the convex surface of the roller 9. Continued movement of the material 9 through the input opening 10 directs the lateral edges of the material 8 in a second direction such that the edges are folded back on the material for forming a continuous strip of cushioning product. More particularly, as shown in FIGS. 7A, 7B and 7C, the convex roller 9 and two pairs of rollers 11, 12 and 13, 14 constitute a conversion assembly through which the paper from the roll 5 is pulled by the feed rollers 6 and 7 to fold and form the paper into pillow-like shapes for use as cushioning dunnage, see paper pillow 15 in FIG. 7B.

The compact apparatus 1 further comprises a perforator 16 driven by the motor 3 for perforating paper material 8 at spaced locations 17 along the length of the material as the material is fed through the apparatus. The line of perforations 17 on each side of the material are edge cuts made by cooperating perforation gears 18 and 19 between which the material is fed.

The perforation gears 18 and 19 are arranged coaxial with the feed rollers 6 and 7 on each side of the material being fed. When the pillow-like shaped material is dispensed from the compact apparatus 1, an operator can rip from the apparatus a desired length of cushioning product, such as pillow 15 in FIG. 7B, because of the spaced perforations 17 in the material.

An input chute 20 and an output chute 21 of the apparatus 1 guide the material 8 on respective sides of the material feeding arrangement 4. The input and output chutes, convex material shaping roller 9, input rollers 11, 12 and 13, 14 and other components of the apparatus are mounted as a unit on the supporting frame 22 of the apparatus. In the example embodiment, the compact apparatus 1 in the form of a pivotal head which is mounted on the floor stand 2, FIG. 6, for multi-directional pivoting for ease of loading paper material. Different positions for the pivotal head I on the floor stand 2 are shown in dashed lines in FIG. 6. It is noted that the size of the input opening 10 delimited by the roller pairs 11, 12 and 13, 14 is small enough to preclude an operator's hand from being inserted through the input opening for operator safety.

Figure 6:
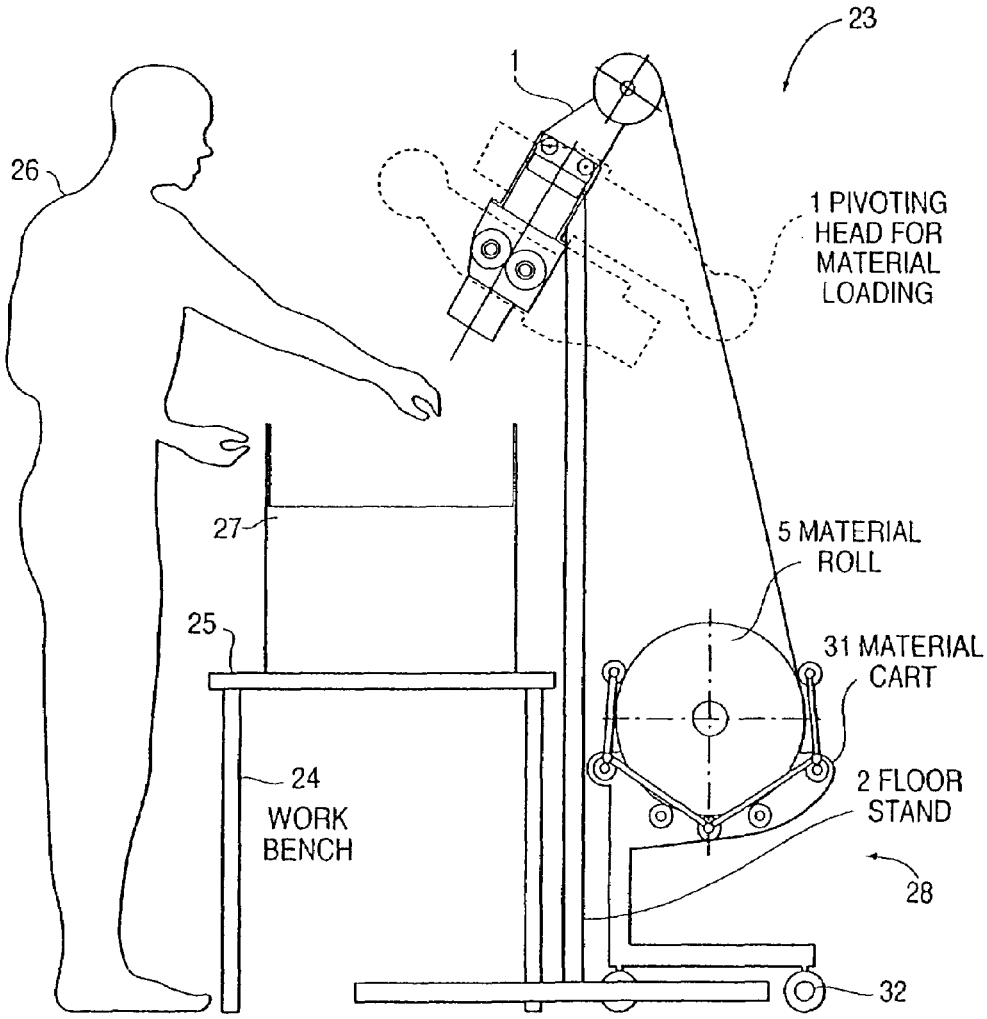
FIG. 6 is a right side view of a first example embodiment of a system of the invention which includes the compact apparatus of FIGS. 1-5 mounted on a floor stand located behind a work bench with a material cart with automatic roll tensioner supporting a material roll supplying paper to the apparatus.

A system 23 of the invention for creating and dispensing material for use as void fill and cushioning dunnage is shown in FIG. 6. The system includes, in combination, the compact apparatus 1 and a stand 2 on which the compact apparatus is mounted. The system 23 further comprises a work bench 24 providing a work surface 25 for an operator 26 for moving pillow-like shaped material 15 from the apparatus 1 and inserting it into the box 27 containing an item to be shipped. The system 23 of FIG. 6 further comprises a roll support 28 which rotatably supports the paper roll 5 from which the material can be unwound by being pulled by the feed rollers 6 and 7 of the compact apparatus 1 for supply to the compact apparatus. The roll support 28 in the system 23 in FIG. 6 is in the form of a material cart 31 with wheels 32.

Figure 8:
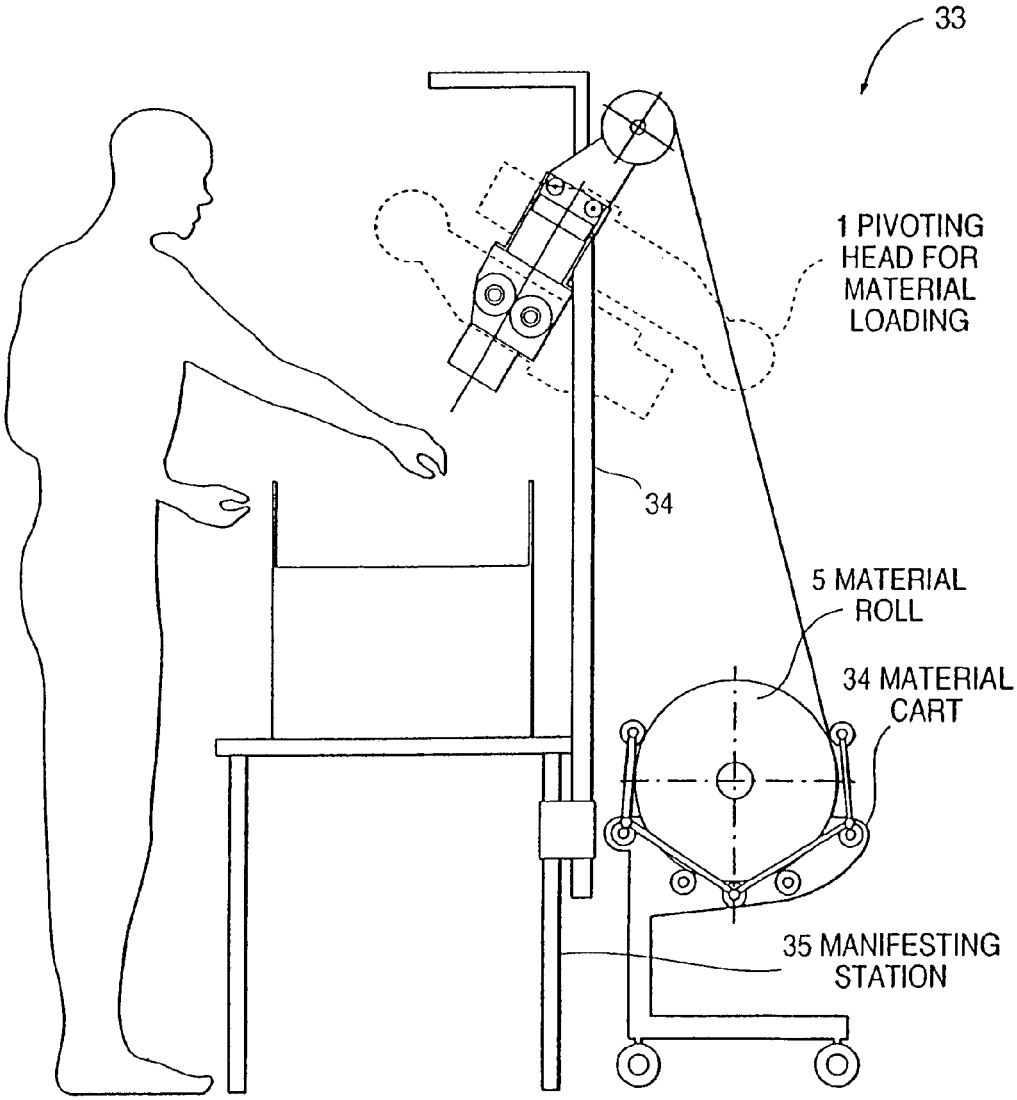
FIG. 8 is a right side view of a second example embodiment of a system according to the invention wherein the compact apparatus is mounted on a manifesting station above a work surface thereof.
Figure 9:
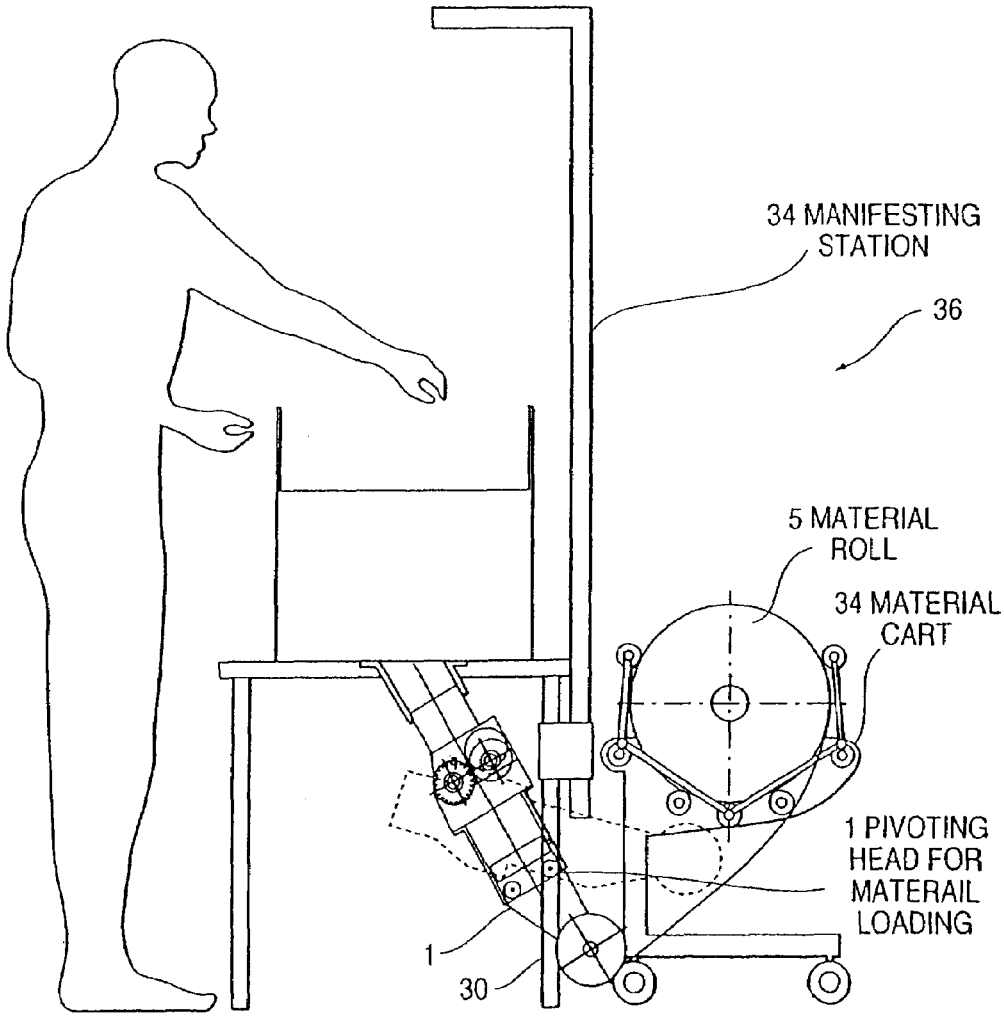
FIG. 9 is a right side view of a third example embodiment of the system of the invention wherein the compact apparatus of the invention is pivotally mounted on a material cart and positioned beneath a work surface of a manifesting station.
Figure 10:
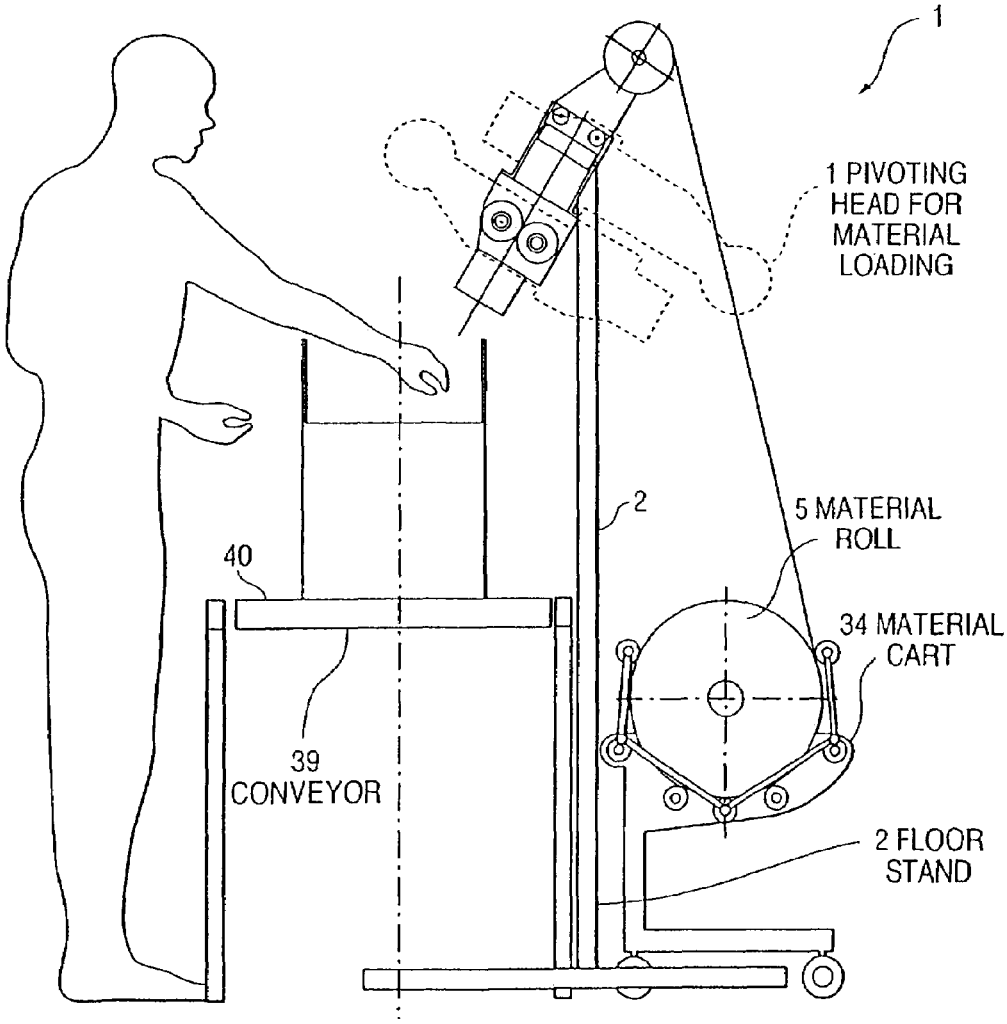
FIG. 10 is a right side view of a fourth example embodiment of the system of the invention having a conveyor providing a work surface in front of a floor stand carrying the compact apparatus of the invention.

The system 33 in the example embodiment of FIG. 8 comprises a stand 34 supported on a manifesting station 35. The system 36 in FIG. 9 is similar to that in FIG. 8, except that the compact apparatus 1 is pivotally mounted beneath the work surface of the manifesting station on a lower leg 30 of the manifesting station. The system 38 in the example embodiment of FIG. 10 employs a floor stand 2 like that in FIG. 6 with a conveyor 39 being located in front of the compact apparatus to provide a work surface 40.

Figure 11:
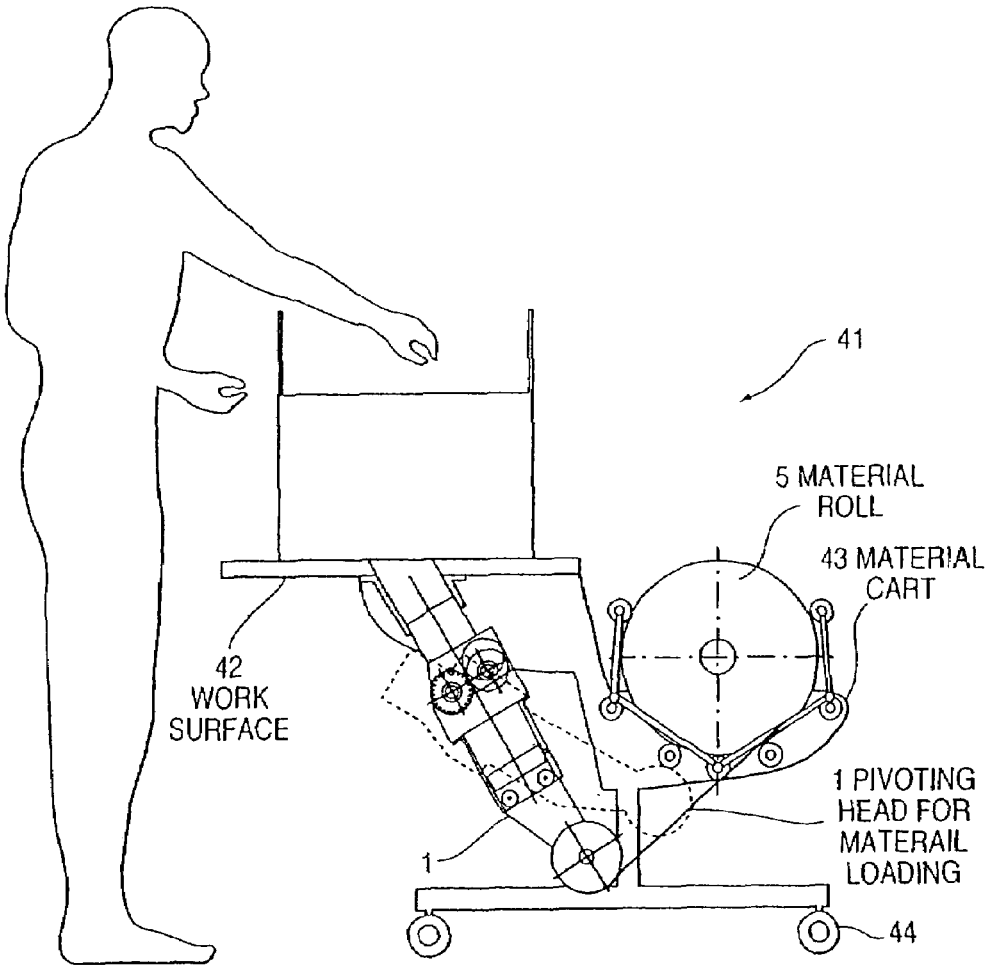
FIG. 11 is a right side view of a fifth example embodiment wherein a material cart of the system includes a work surface and has the compact apparatus pivotally mounted to the cart.

The system 41 of FIG. 11 integrates the work surface 42 with material cart 43. The cart 43 also serves to pivotally mount the compact apparatus 1 beneath the work surface 42. The entire system is portable because of the wheels 44 on the cart 43.

Figure 12:
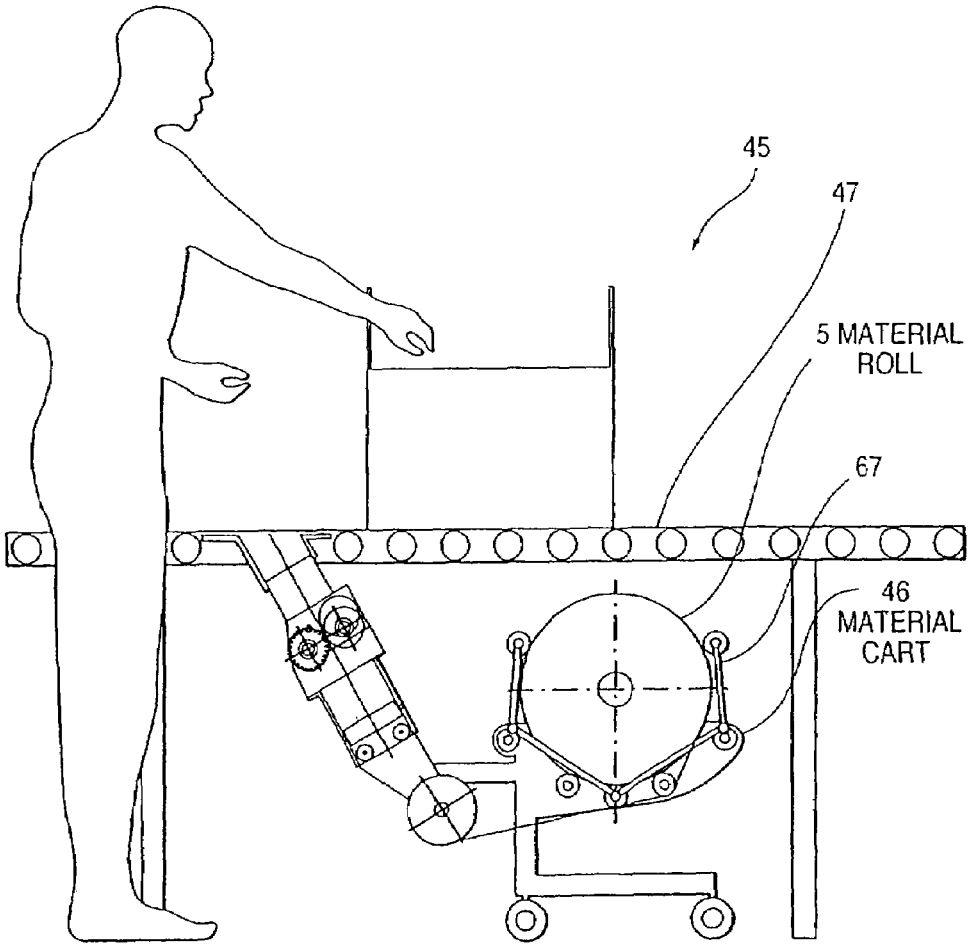
FIG. 12 is a right side view showing a sixth example embodiment wherein the entire material cart with compact apparatus mounted thereon is located beneath a conveyor of the system.
Figure 13:
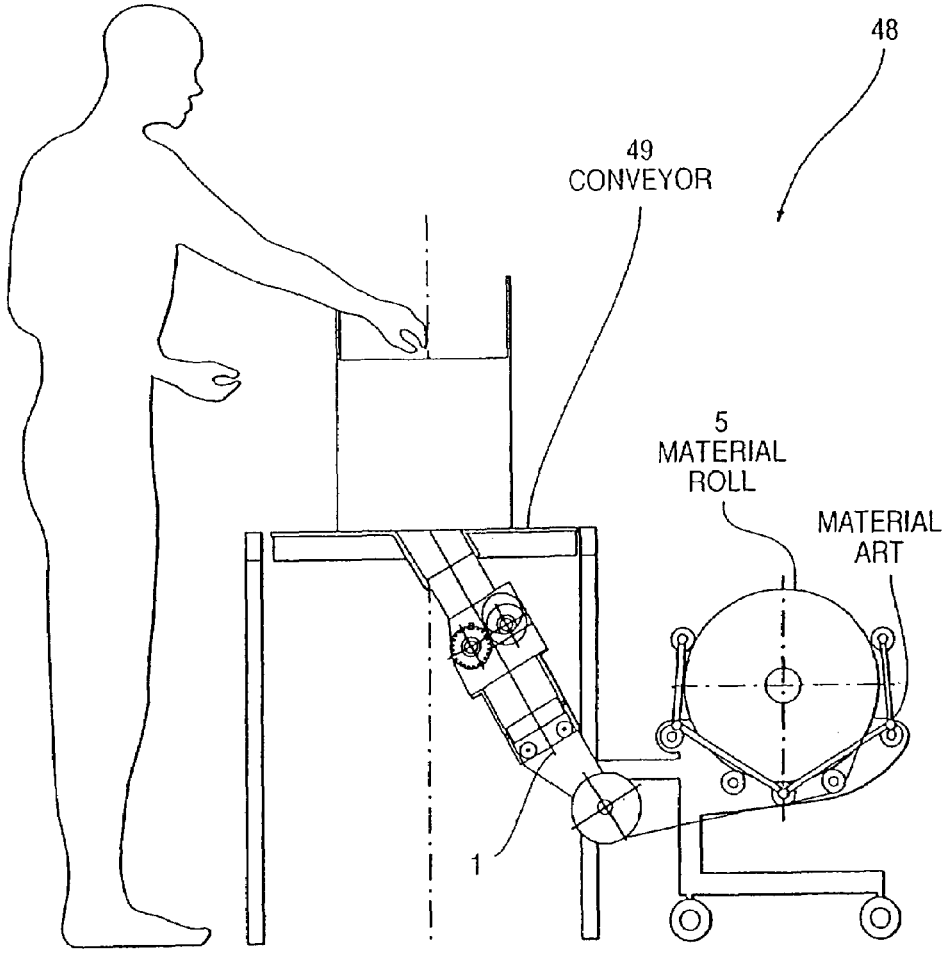
FIG. 13 is a right side view of another example embodiment of the system wherein the material cart is located behind a conveyor and supports the compact apparatus in a position beneath the conveyor.

A system 45 in the example embodiment of FIG. 12 employs a material cart 46 with roll tensioner 67 that pivotally supports the compact apparatus 1 beneath a conveyor 47. The system 48 of FIG. 13 is similar to that in FIG. 12, except that the material cart is located behind the conveyor 49 with only the compact apparatus 1 located beneath the conveyor.

Figure 14:
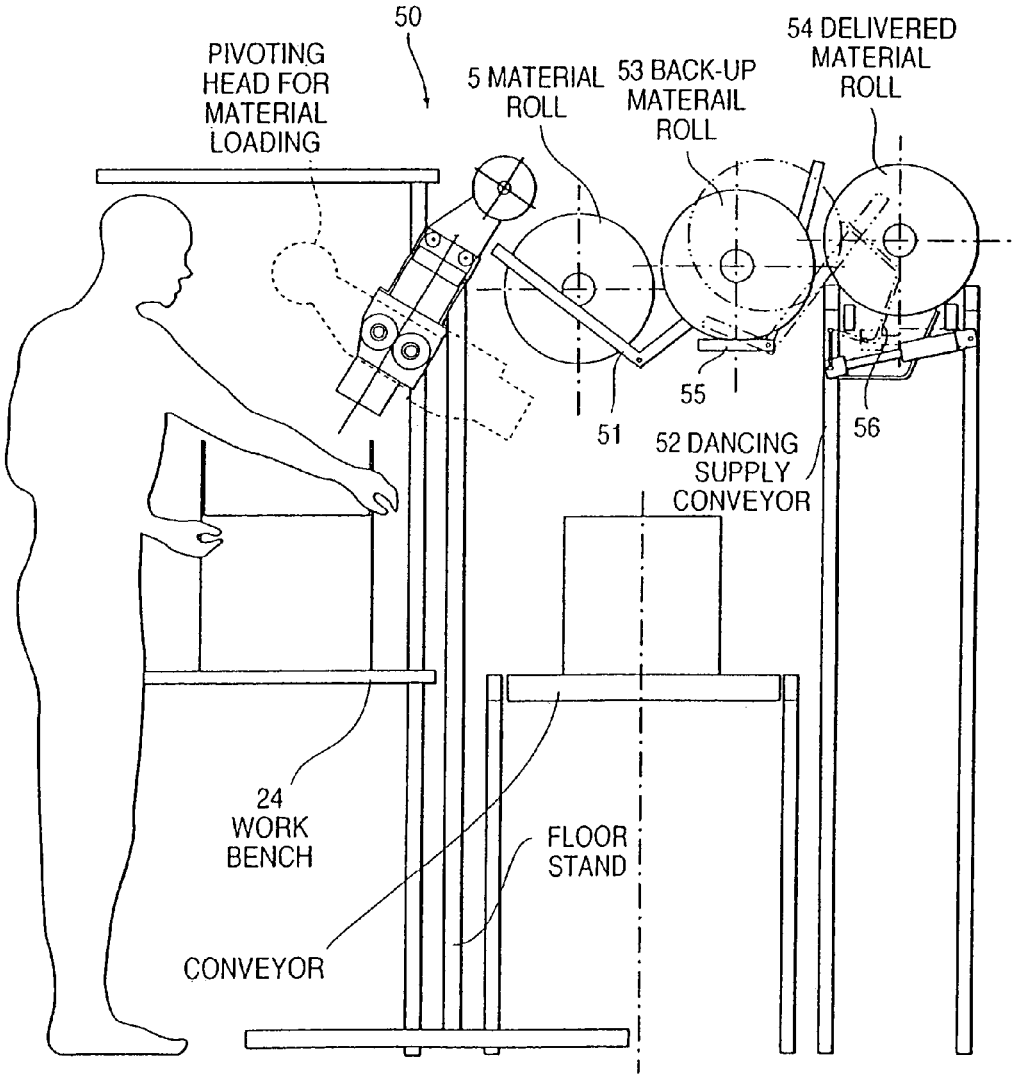
FIG. 14 is a right side view of a further example embodiment of the system depicting an elevated roll delivery arrangement thereof for supplying rolls of material to be used for creating a cushioning product with the system.
Figure 15:
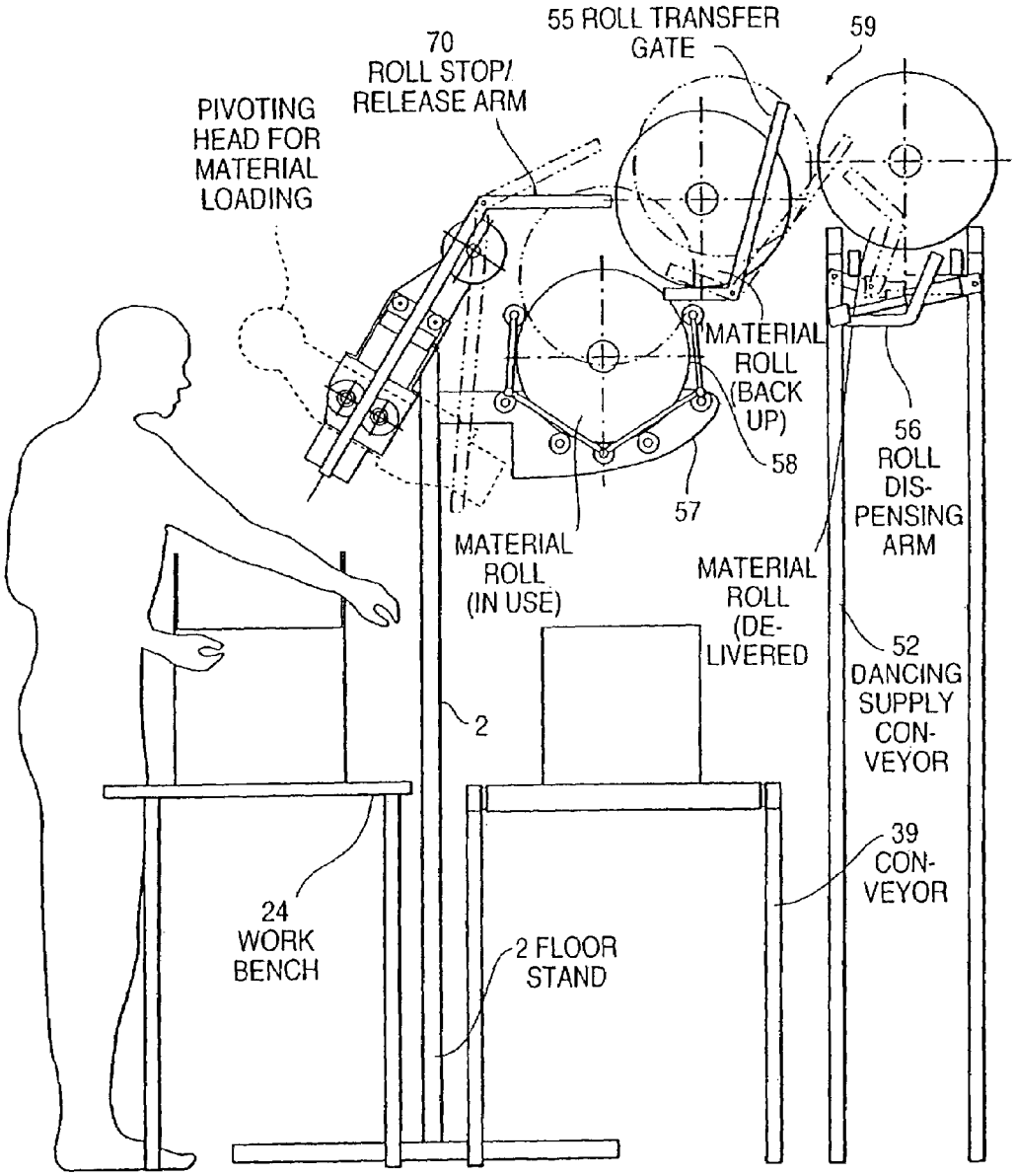
FIG. 15 is a variation of the system according to FIG. 14 schematically showing the use of a roll tensioner as part of the roll support.

A system 50 in FIG. 14 includes an elevated roll support 51 for the material roll 5 with a dancing supply conveyor 52 supplying a back-up material roll 53 for delivery to the roll support 51 to replenish the paper supply as needed. The dancing supply conveyor 52 presents a delivered material roll 54 as depicted in FIG. 14. The delivered material roll 54 is transferred to the position of the back-up material roll 53 by the pivotal transfer arms 55 and 56 shown schematically in FIG. 14. A variation of the system of FIG. 14 is shown in FIG. 15, wherein roll support 57 includes pretensioner 58. The roll 15 support is mounted on the floor stand 2 and the dancing supply conveyor 52 in the system 59 of FIG. 15.

Figure 16A:
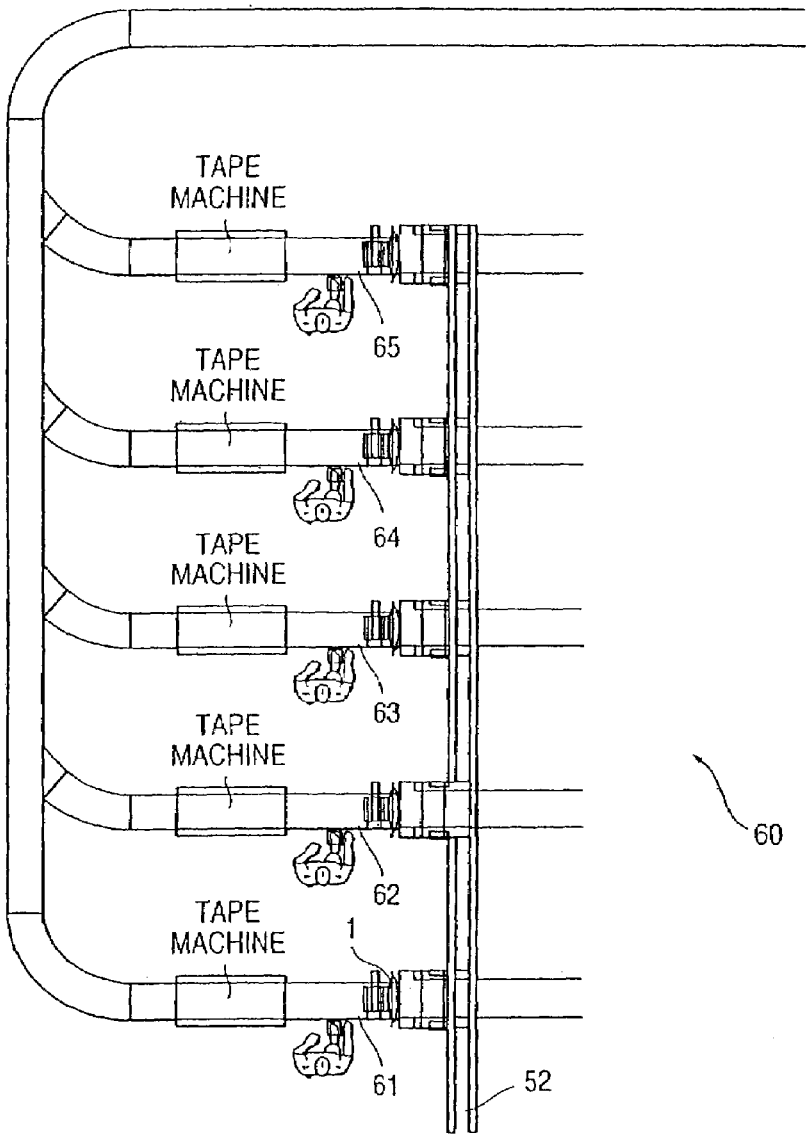
FIG. 16A is a top view of an additional system of the invention wherein an overhead roll delivery arrangement supplies material rolls to a plurality of individual workstations, each having a compact apparatus of the invention.
Figure 16B:
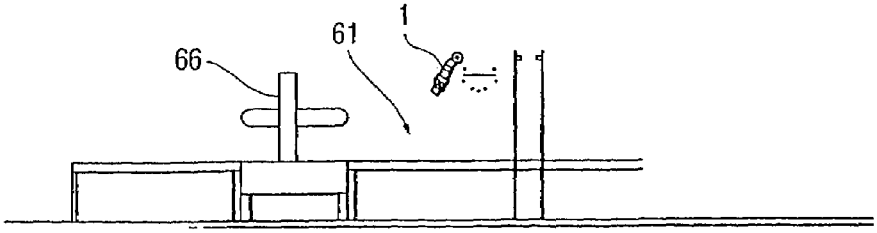
FIG. 16B is a front side view of one work station of the system of FIG. 16A.

The overhead dancing supply conveyor 52 is schematically shown in the system 60 of FIGS. 16A and 16B, wherein the conveyor supplies material rolls to five individual packing stations 61 through 65. Each of the packing stations is provided with a compact apparatus 1 of the invention supported above a work surface for creating and dispensing cushioning dunnage to the operator packing items and containers at the work station. One of the stations, 61, is shown schematically in side view in FIG. 16B. A taping machine is represented at 66.

The operation of the overhead roll-delivery system in FIGS. 14 and 15 will now be described. In a first step, paper rolls move (walk) on the dancing conveyor 52 until a roll-transfer gate, pivotal transfer arm, 55 (closed) stops the roll from moving. When the roll stops moving, the roll-dispensing pivotal transfer arm 56 pushes the roll out of tracks of the dancing conveyor. After the roll is pushed out of the dancing conveyor, the roll will stop against the roll-stop/release arm 70, shown in FIG. 15. As long as a roll stays against the roll-stop/release arm 70, the roll-transfer gate 55 stays open, allowing rolls of paper to move on the dancing conveyor to the next available station. When a new roll of paper is needed for a dispensing unit, e.g., one of the stations 61-65, for example, the operator uses the roll-stop/release arm 70 to release the stand-by roll so that the paper roll can fall into the auto-roll tensioning device 58 as shown in FIG. 15. At this point, the roll is ready to be used. After a roll falls into the auto-roll tensioning device, the roll-transfer gate 55 closes.

In the example embodiments, the paper material preferably has an initial width of 24 to 34 inches. After the edges are folded by the conversion assembly of the apparatus, the width of the pillow-shaped product is reduced to 7-8 inches, for example, with the continuous strip being perforated at 17 on each side every 7 inches, for example. The apparatus and dunnage product could, of course, be dimensioned for producing other sizes of cushioning product.

In use, the operator manually feeds the paper or other material from the supply roll 5 located in the vicinity of the compact apparatus 1 by pressing a feed switch 68 on controller 69, FIG. 1, until the paper extends from exit chute 21 at the front of the unit 1. The operator presses on a foot switch, not shown, to begin dispensing paper. As paper moves through the inside of the unit 1, the paper is folded and formed into pillow-like shapes for use as cushioning dunnage. The formed material is uniformly perforated on each side edge every 7 inches at 17 in the example embodiment. When a desired length of the cushioning product is reached, the operator releases the foot switch to stop dispensing cushioning product. The operator rips the cushioning product from the unit at a desired perforation line and places the product in the box 27 to use for void-fill or cushioning.

The compact apparatus and system of the invention is advantageously affordable and practical for customers whose packing needs can be met with a single unit that doesn't take up a lot of space. It also can also flexibly serve the needs of customers with high-speed and high-volume production lines where multiple, stand alone packing stations such as 61-65 and/or centralized packing stations are utilized. Raised flexible installation configuration options, which can be installed over or under work benches, and over or under conveyor lines, are shown in the several example embodiments. Multi-directional pivoting of the unit 1 on the stand/material cart is for ease of loading the paper material 8 in unit 1. Because perforation is achieved in the is paper material on-site and in real-time, pre-perforated paper need not be provided on a roll.

Another embodiment of a compact apparatus 71 of the invention is partially illustrated in FIGS. 17-20D. The apparatus 71 is like that in FIGS. 1-5, and useable in systems as in FIGS. 6 and 8-16B, with the difference that instead of using perforator gears 18 and 19 as in compact apparatus 1, the apparatus 71 comprises cooperating feed rollers 72 and 73 wherein at least one of the feed rollers is a rotary cutting die. In the example embodiment only one of the feed rollers, 72, is a rotary cutting die having a plurality of cutting blades 74 on its surface for cutting slits 86 in material at spaced locations along the length of the material as the material is fed through the apparatus to allow an operator to rip from the apparatus a desired length of cushioning product being dispensed by the apparatus, see the length 75 ripped from the material as shown schematically in FIG. 20D.

The feed roller 73 in the example embodiment has a smooth, annular surface so that it acts as an anvil against which the material being fed between the rollers can be cut by the blades 74 on roller 72. The rollers are driven by motor 76 through transmission 77 under the control of controller 78, the operation of which is like that described in reference to the embodiment of FIGS. 1-5 and the systems of FIGS. 6 and 8-16B. The input rollers 11-14 and material shaping roller 9 shown in FIGS. 1-5 are also used in the compact apparatus 71 although not shown in FIGS. 17-20D for simplicity.

Figure 17:
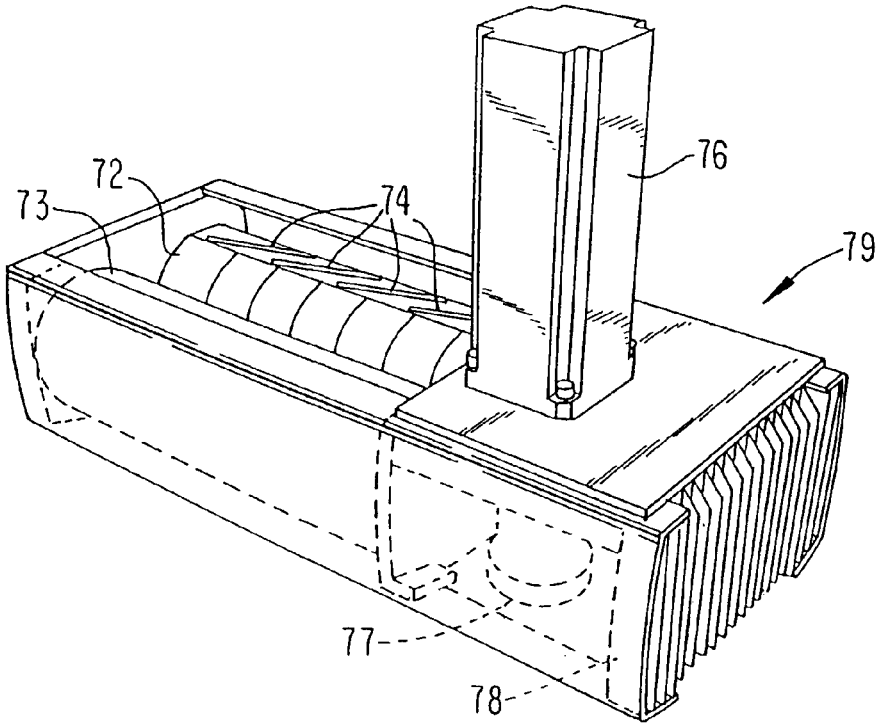
FIG. 17 is a perspective view from the front right and somewhat above a rotary die cut assembly of another embodiment of a compact apparatus of the invention for creating and dispensing material for use as void fill and cushioning dunnage.
Figure 18:
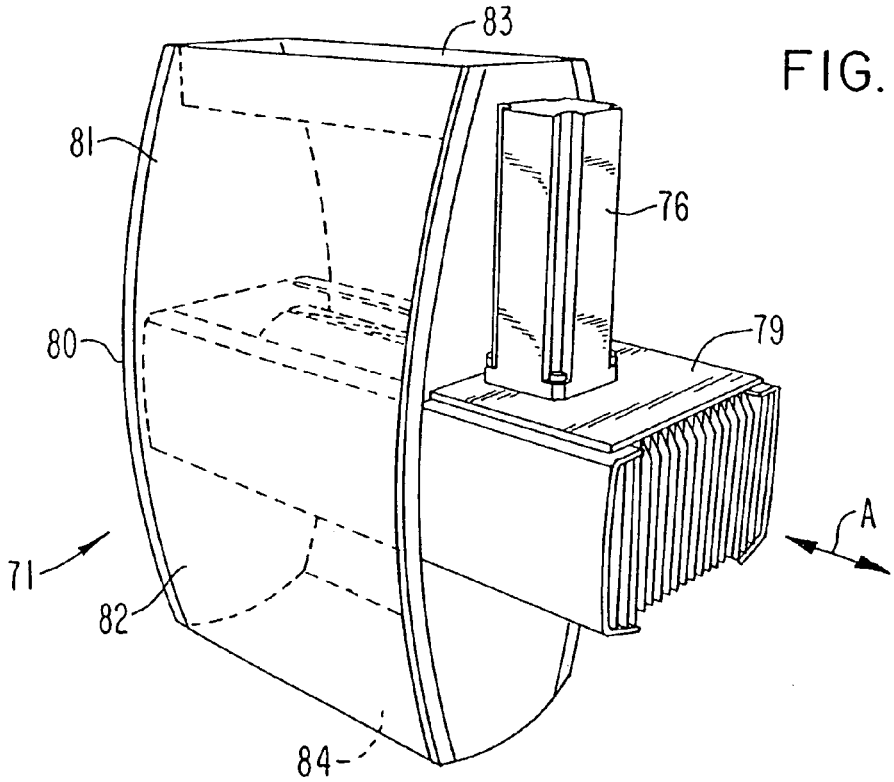
FIG. 18 is a perspective view from the front right of the rotary die cut assembly of FIG. 17 removably installed as a unit in a cavity of a housing of the compact apparatus defining input and output chutes for material fed through the apparatus, the apparatus otherwise being like that shown in FIGS. 1-5, and useable in the systems shown in FIGS. 6 and 8-1GB.
Figure 19A:
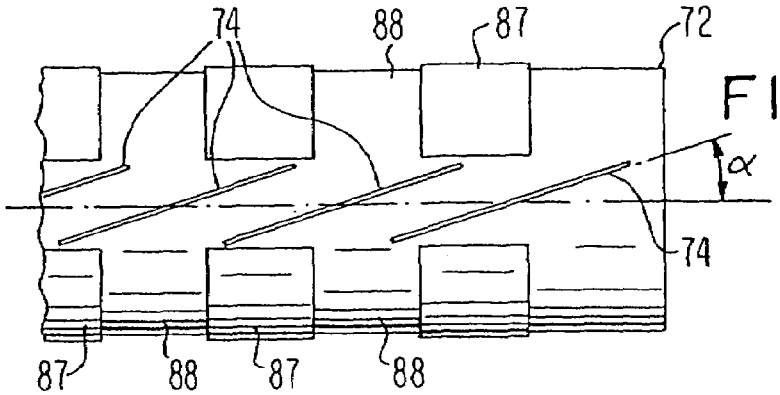
FIG. 19A is a top view of the right side of a feeding roller of the die cut assembly of FIGS. 17 and 18, the feeding roller being a rotary cutting die having a plurality of cutting blades on its surface.
Figure 19B:
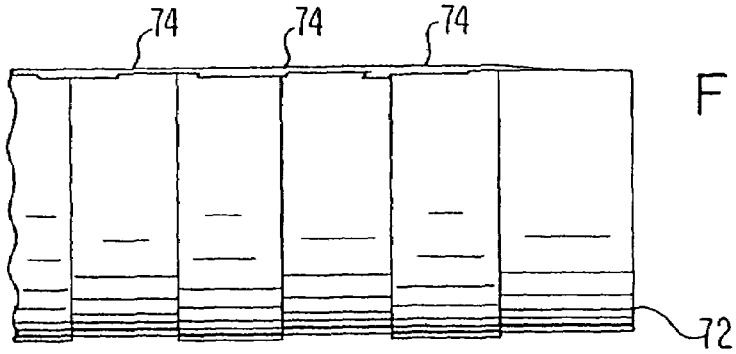
FIG. 19B is a front side view of the feeding roller which also serves as a rotary cutting die as seen from below the roller in FIG. 19A.
Figure 19C:
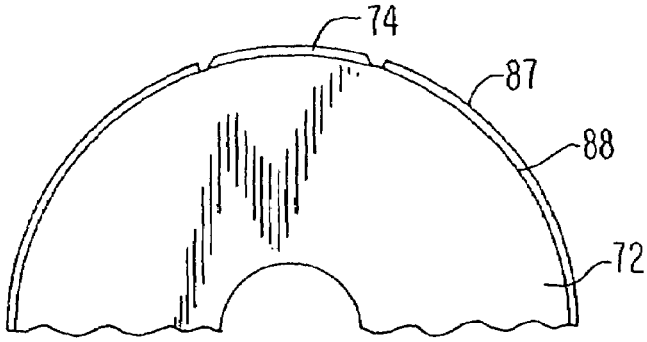
FIG. 19C is a partial end view of the feeding roller/rotary cutting die as seen from the right end of the roller in FIG. 19B.
Figure 20A:
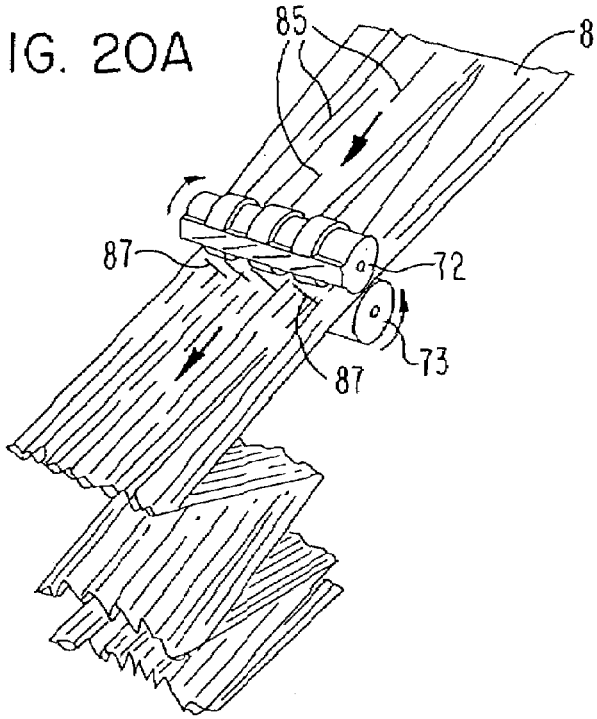
FIG. 20A is a schematic representation in perspective of the feed rollers of the apparatus of FIGS. 17-19C showing the continuous strip of material, shaped with its width reduced to form longitudinally extending convolutions across the width of the material with angled slits formed therein by the rotary cutting die of the material feeding arrangement, the material being folded on itself downstream of the feeding roller by a hinge effect at the spaced locations of the slits along the length of the material.
Figure 20B:
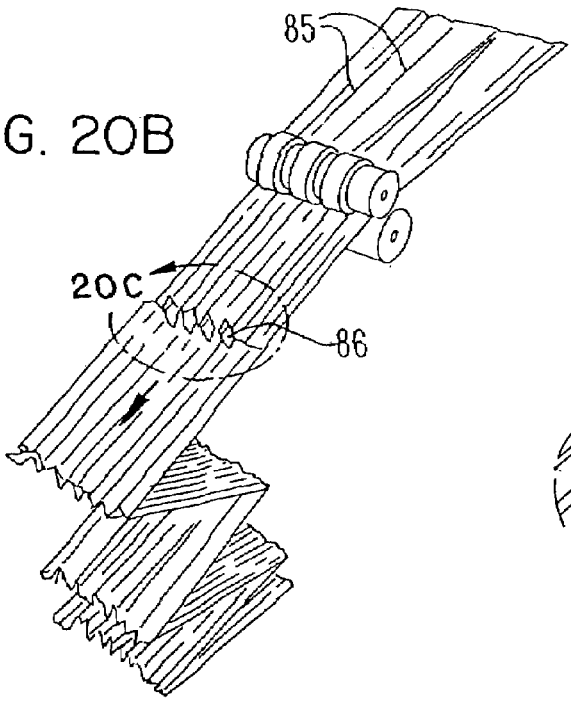
FIG. 20B is a schematic, perspective view similar to FIG. 20A and showing in more detail the opening of the slits through random convolution of the material into an irregular honeycomb-like structure during separation of the material.
Figure 20C:
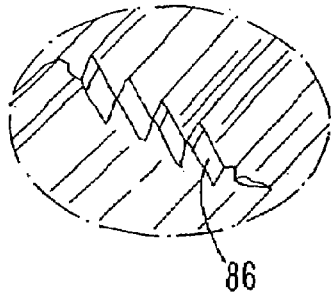
FIG. 20C is an enlarged view of the irregular honeycomb-like structure within the circle 20C in FIG. 20B.
Figure 20D:
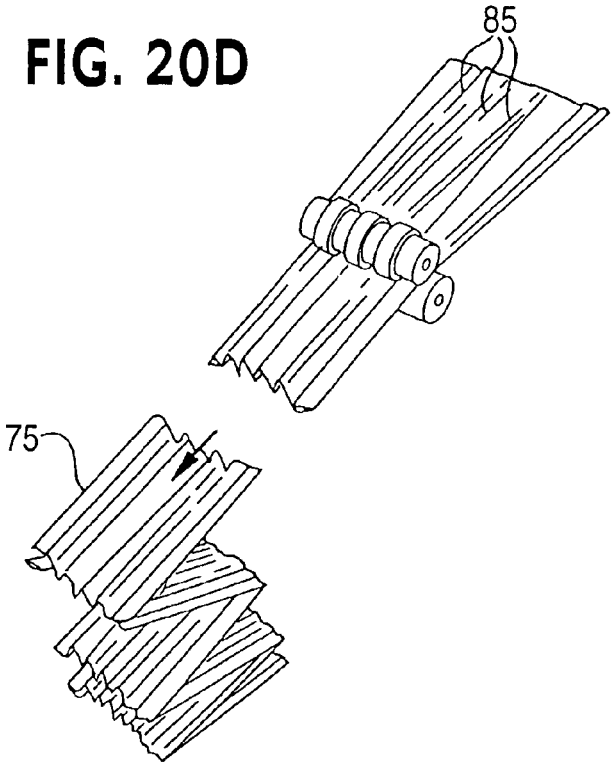
FIG. 20D is another schematic, perspective view like FIGS. 20A and 20B showing a separated length of material ripped from the strip by the operator in the direction of the arrow.

The rotary cutting die assembly, 79 in FIG. 17, is a unit which can be removably installed in the open-ended chute structure 80 of the apparatus 71 in the direction of arrow A as depicted in FIG. 18 from either side of the apparatus. The structure 80 forms input and output chutes 81 and 82, respectively, leading to and from the cooperating feed rollers in the compact apparatus through respective openings 83 and 84. The cutting blades 74 on the rotary cutting die/feed roller 72 are arranged at an angle a to the roller axis B-B as shown in FIG. 19A. The angle a is 18° in the example embodiment, but could be another angle, although preferably a is within the range of 10° and 80° for the reasons discussed below. The blades are embedded in the roller surface with their outer cutting edges protruding from the roller surface and following the roller circumference as seen in FIGS. 19B and 19C. The smoothed surface feed roller 73 in the example embodiment is formed of an ultrahigh molecular weight plastic. The roller has a diameter slightly different from roller 72 for even wear. The material 8 fed between the rollers 72 and 73 is pinched between the opposed surface of the rotatably driven rollers for feeding and cutting slits in the material.

The plurality of shaping rollers upstream of the rotary cutting die assembly 79 are preferably dimensioned and adjusted to reduce the width of the material so that random convolutions 85 are formed in the material across the width of the material. This is done without folding back the edges of the material as in the product of FIGS. 7A-7C. The rollers are rotatably mounted so as to move with the contacting strip of material thereby minimizing sliding contact and friction. The material, including these convolutions are slit by the rotary cutting die. This feature, together with the angle of slits 86 cut into the material convolutions, results in a cushioning product in which separation of the material starts with the expansion of the slits through the random convolutions of the paper or other material into an irregular honeycomb-like structure 86, see FIGS. 20B and 20C. Separation of the material is completed with the fracture of the honeycomb structure to provide a length 75 of the material, FIG. 20D, upon ripping by the operator.

The feed roller/rotary cutting die 72 in the example embodiment has a is circumferential surface with annular portions 87 and 88 of relatively larger and relatively smaller diameter spaced along the roller axis B-B. The cutting blades 74 are located intermediate the axial ends of the roller and circumferentially between the opposite ends of the relatively larger diameter annular portions 87 as seen in FIG. 19A. The void fill and cushioning dunnage produced by the compact apparatus 71 advantageously exhibits a hinge effect at each slit area along its length as it is fed from the apparatus so that the material readily folds on itself during dispensing as shown at 87 in FIGS. 20A-20C. It has been found that this helps rapidly fill voids in packages with little effort by the operator once the filling process is started. The slits also enable quick ripping of a length of the material from the continuous strip once the package has been filled.

Figure 26:
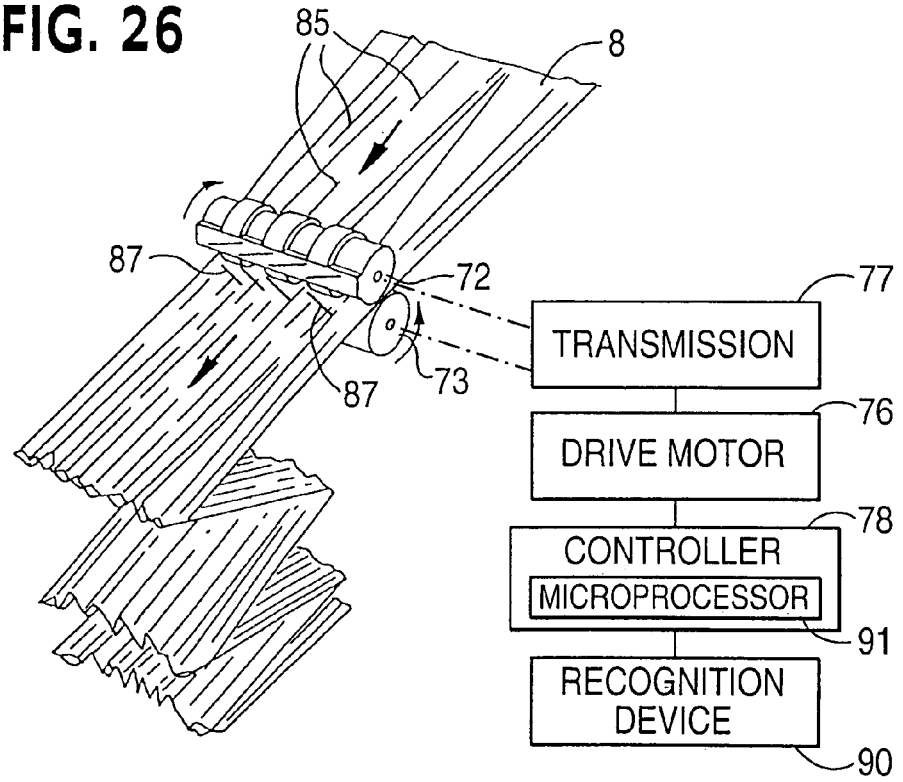
FIG. 26 is a schematic representation in perspective like FIG. 20A and further schematically illustrating a recognition device of the apparatus for detecting at least one marking provided on a roll of material to be converted into a cushioning product, a signal from the recognition device being provided to the controller of the apparatus which includes a microprocessor.

The efficiency of the operation of the systems and methods of the invention as in FIGS. 6 and 8-16B, using compact apparatus 1 or 71, is improved using material identification according to a further feature of the invention. According to this feature, an optical device 90 and software in programmed microprocessor 91 of the controller, 78 in FIG. 26, as described below are added to the system electronic control device, e.g., controller, 69 or 78. Enhanced operational efficiency is achieved performing one or more of:

Recognizing specific characteristics of the roll of material, e.g., about the material and/or the roll itself;

Tracking usage of material processed by the system; and

Tracking amount of material processed by the system.

Examples of characteristics of the roll of the material that can be identified and/or tracked by the electronic control device are:

Type of materials, e.g. bogus, newsprint, Kraft®, percent of recycled material, trimmed, untrimmed, paper, polymer, composite, etc;

Weight of the material; e.g. 40 lb. paper material, 80 lb. paper material, etc.;

Thickness of the material, e.g., 0.01 inch material, 0.005 inch material, etc.;

Weight of the roll of material, e.g. 30 lb. roll, 60 lb. roll, etc.;

Diameter of the roll of material, e.g., 7 inches, 13 inches, etc.;

Width of the roll of material, e.g. 12 inches, 24 inches, 27 inches, etc;

Presence or absence of a core around which the material is wound; and

Dimension and/or shape of a core around which the material is wound.

The ability to recognize characteristics of the roll of the material, and the ability to track usage and amount of material processed by the system, enables the system and its controller to operate more efficiently. For example, pulling bogus paper from its roll requires a longer acceleration/deceleration profile than pulling Kraft® paper from its roll in order to avoid or minimize ripping the material. As another example, pulling material from a heavy roll, such as a 60 lb. roll, requires a longer acceleration/deceleration profile than pulling material from a 30 lb. roll. To this end, the method of the invention includes identifying a characteristic of the roll of material which corresponds to a desired pulling profile for the material, and adjusting an acceleration/deceleration profile of the pulling as a function of the identified characteristic.

The optical device 90 is a recognition device added to the system of the invention to detect information provided on the roll of material concerning a characteristic of the roll of material, e.g., about the material and/or the roll itself, and to provide a signal thereof from the recognition device to the controller, 69 or 78 in the example embodiments. The recognition device is a scanner in the example embodiment, which is used with software in microprocessor 91 in the controller to recognize, process and track markings on the roll of material.

Figure 25A:
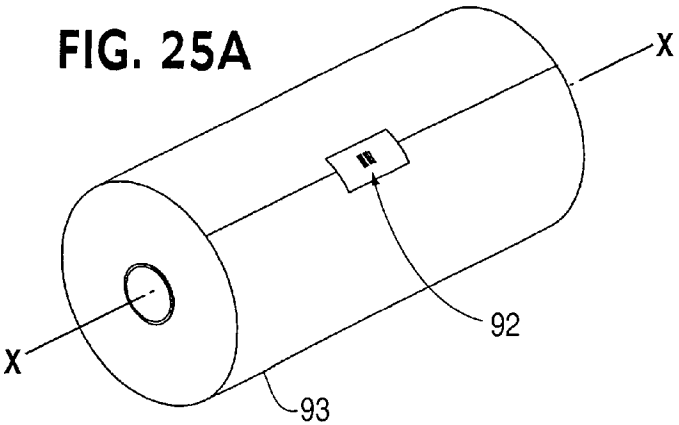
FIG. 25A is a roll of material for use in the system and apparatus of the invention, the roll of material being provided with a removable label with a bar code, magnet, microchip, hologram or other identification system capable of being identified by a recognition device, such as a scanner, or visibly recognized by the operator, of a system of the invention and in accordance with a method of the invention.
Figure 25B:
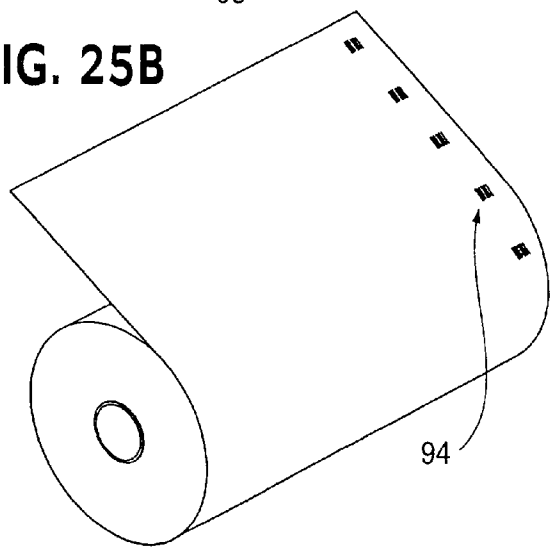
FIG. 25B is another example of a roll of material for use in the system, apparatus and method of the invention, the material being provided with a repetitive pattern or other identification system.
Figure 25C:
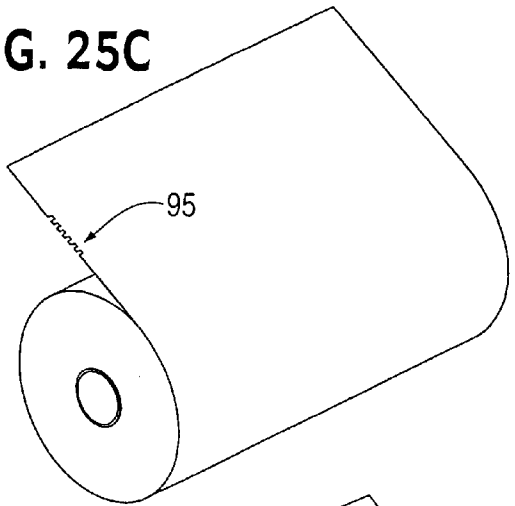
FIG. 25C shows a roll of material like FIGS. 25A and 25B but wherein an edge of the material has a pattern which is cut, embossed, extruded, punched or otherwise formed therein.
Figure 25D:
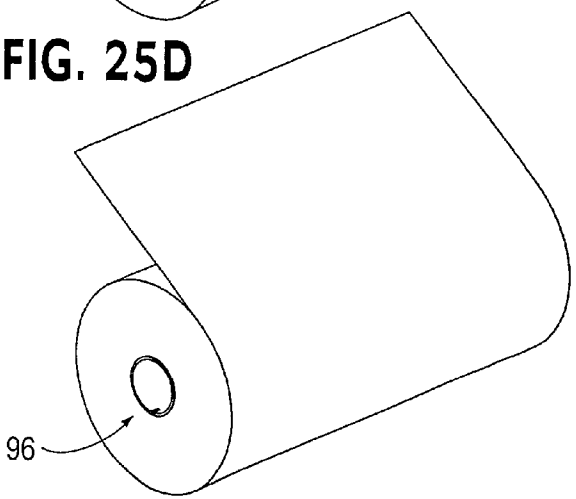
FIG. 25D depicts a roll of material for use with a method, system and apparatus of the invention, the roll of material having a core which is tagged with a microchip, magnet, hologram, bar code or other identification system.

Examples of various "markings" which can be provided on the roll of material for producing the method are shown in FIGS. 25A-25D. in FIG. 25A a removable label 92 with identificable name, text, logo or some other visual symbol, or with a bar code, magnet, microchip, hologram or some other identification system that uniquely identifies the material itself and/or the roll of material, is provided on the roll of material 93. In FIG. 25B, the material of the roll is printed at 94 with a single, continuous or repetitive pattern. The marking can also be formed, cut, embossed, extruded or punched in an edge with a single, continuous or repetitive pattern as at 95 in FIG. 25C. FIG. 25D shows a roll of material whose core is marked at 96, e.g., tagged with a microchip, magnet, hologram, bar code or other identification system. These markings on the roll of material are seen/scanned/read by the recognition device 90 and the software in microprocessor 91 which automatically adjusts the pulling profile to that best suited for efficient operation. Alternatively, the markings could be visually read by the operator and the desired pulling profile manually input at the controller.

The recognition device 90 can be located externally from the controller somewhere on the system in proximity to the material or roll. The recognition device could also be a hand held device used by an operator. When connected to the system, for example, it could be mounted for detecting markings on stationary or rotating rolls in the roll tensioner of the system, or mounted on the stand to scan the markings when the material is pulled from the roll and fed through the compact apparatus 1/71.

Another example embodiment of a system 96 of the invention is depicted in FIGS. 21-24C of the drawings. The system 96 comprises a compact apparatus 97, like either compact apparatus 1 or 71 of the previous embodiments, for creating and dispensing material for use as a void fill and cushioning dunnage. The compact apparatus 97 is mounted on a floor stand 98. The stand also supports an automatic roll tensioner 99 which supports a roll of material 93 of paper, plastic or other material to be formed into a cushioning product by the system. A recognition device 90 is mounted on the stand to view markings on the material being pulled toward the compact apparatus 97 for material identification and tracking as discussed above.

Figure 21:
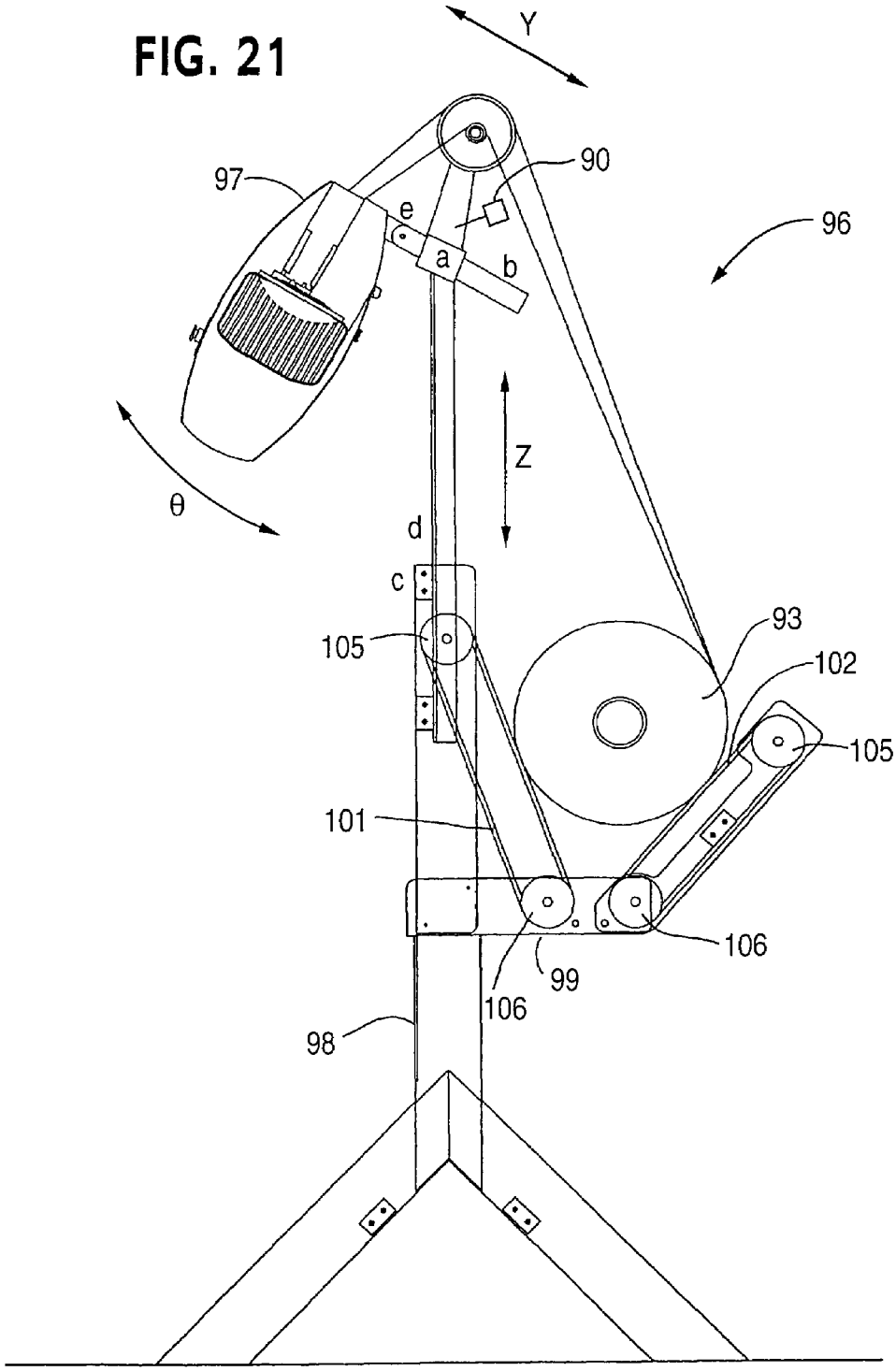
FIG. 21 is a right side view of another example embodiment of the system depicting a compact apparatus of the invention for creating and dispensing material for use as a void fill and cushioning dunnage, mounted on a stand with an automatic roll tensioner of the invention which supports a material roll supplying paper, plastic or other material to the apparatus.
Figure 22:
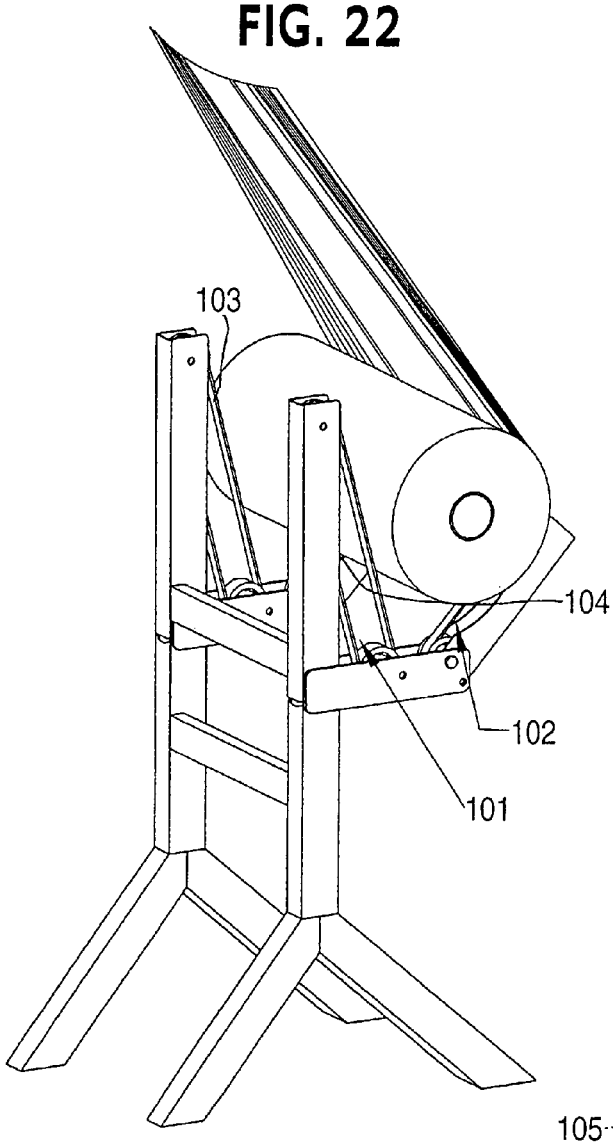
FIG. 22 is a perspective view from the front and to one side of the lower part of the stand and roll tensioner of the system of FIG. 21.
Figure 23:
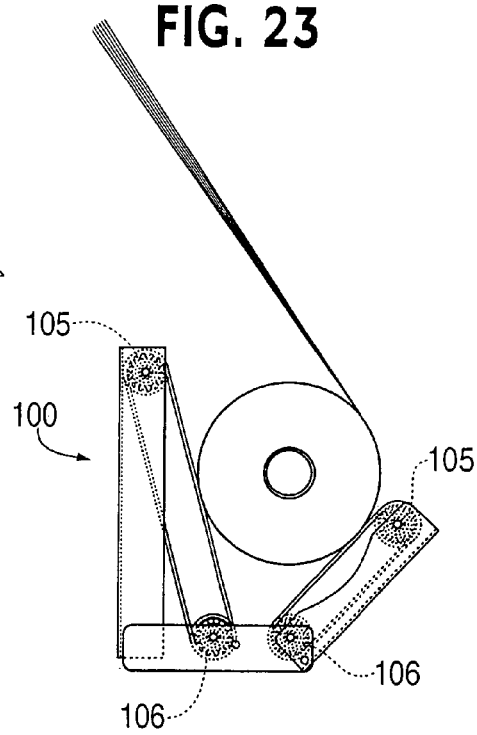
FIG. 23 is right side view of the automatic roll tensioner shown in FIGS. 21 and 22.

The compact apparatus 97 of the system 96 can be moved manually linearly on the Y-axis, see FIG. 21, to position the compact apparatus to achieve proper clearance from cartons or other containers or equipment and to provide easy access to the compact apparatus by an operator. Movement of the compact apparatus manually is also possible linearly on the Z-axis. FIG. 21, to position the compact apparatus for proper clearance above cartons or other containers or equipment, and to provide easy access to the compact apparatus by an operator. The linear movements are achieved by linear slides in the example embodiment, e.g. c and d stand components slide relative to each other, and components e, b of the compact apparatus slide relative to stand sleeve a in FIG. 21.

The compact apparatus 97 can also be manually pivoted about the Y- and Z-axes to position the compact apparatus for proper clearance from cartons or other containers or equipment and to provide easy access to the compact apparatus by an operator. These adjustments allow dispensing of material linearly on any combination of the Y- and Z-axes.

These positioning possibilities for the compact apparatus 97, and the pivoting of the compact apparatus which is possible in the direction θ in FIG. 21, provide three degrees of freedom of movement or adjustability for the compact apparatus on the floor stand 98. In addition, or alternatively, to the use of linear slides for achieving manual movement of the compact apparatus, pulleys and chains, pulleys and timing belts, a ball screw, and various linkages are other mechanisms could be provided for achieving the manual movements. As another variation, movement of the compact apparatus as described could be accomplished automatically by means of at least one of a electric actuator, a pneumatic actuator, or a hydraulic actuator, for example.

The automatic roll tensioner 99 in the system 96 in FIGS. 21-24C comprises a roll support arrangement 100 for positioning a roll of material 93 to permit the roll to be rotated, counterclockwise as shown in FIG. 21, about a longitudinal axis of the roll, shown at X-X in FIG. 25A, by pulling the material from the roll with the motor and the material feeding arrangement driven by the motor of the compact apparatus 97, to unwind material from the roll. In the example embodiment of FIGS. 21-23, the roll support arrangement 100 has four roll support members in the form of belts 101-104, each rotatably mounted on respective pairs of rotatable pulleys 105 and 106, for applying rolling frictional resistance to rotation of the roll 93 at a plurality of circumferentially spaced locations on the periphery of the roll of material positioned by the arrangement 100. The four belts, two on each side of the roll 93, form respective sides of a V-shaped cradle configuration of the roll tensioner for supporting and positioning the roll of material as well as supplying frictional resistance to rotation of the roll for tensioning the material being pulled from the roll. The roll 93 is fully supported by the four belts which apply an amount of frictional resistance in proportion to the weight of the roll supported on the belts.

Figure 24A:
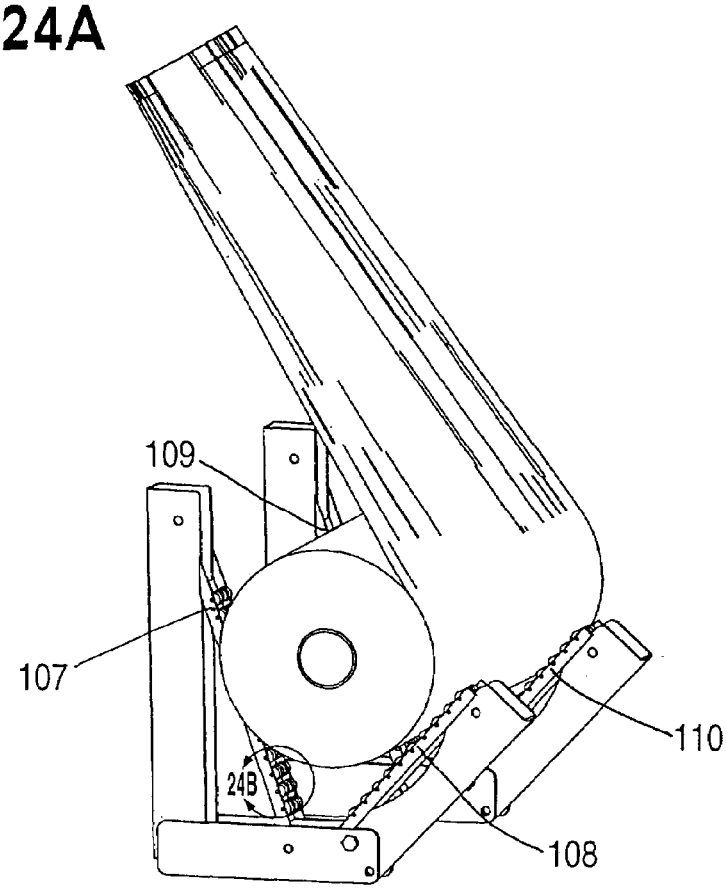
FIG. 24A is a perspective view from the back and to one side of a variation of the automatic roll tensioner shown in FIGS. 21-23.
Figure 24B:
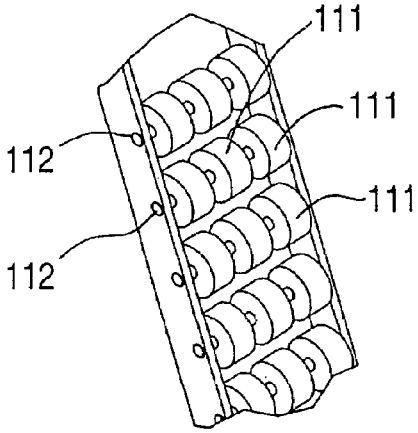
FIG. 24B is an enlarged view of a portion of the roll tensioner of FIG. 24A within the circle 24B.
Figure 24C:
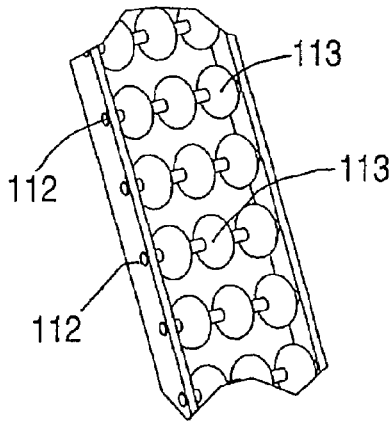
FIG. 24C is an enlarged view of a portion of a roll tensioner like FIG. 24B but where the cylindrical rollers have been replaced with spherical rollers.

An alternate form of the roll support members for the automatic roll tensioner 100 is shown in FIG. 24A and 24B wherein instead of belts, four individual arrays 107-110 of rotatably mounted elements are used to form the V-shaped cradle configuration for the roll of material. The rotatably mounted elements are cylindrical rollers 111, FIG. 24B, mounted three rollers per axle/support shaft 112. A variation of this arrangement is shown in FIG. 24C wherein the rotatably mounted cylindrical elements are spherical rollers 113, mounted three per shaft/axle 112.

Figure 27:
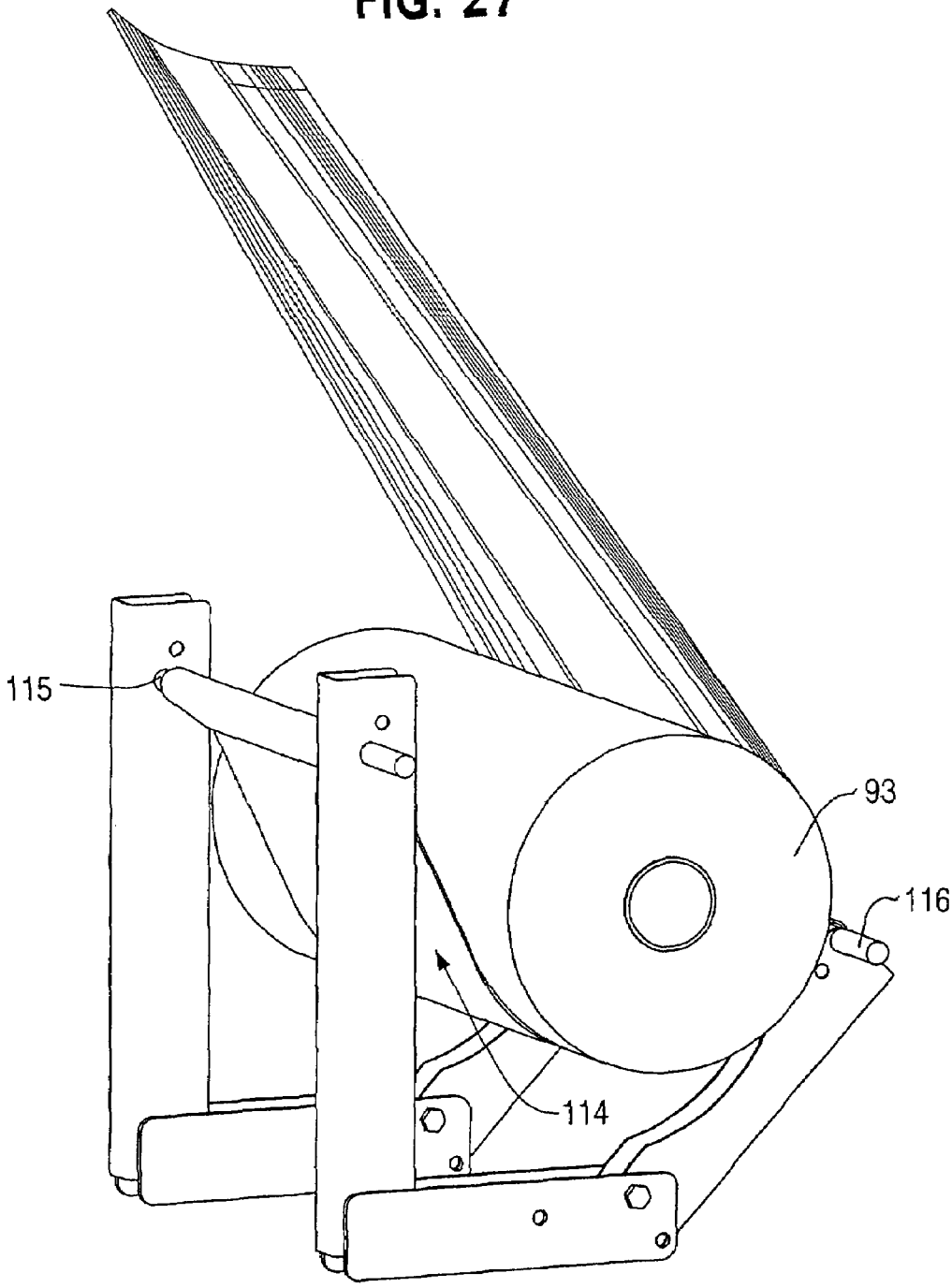
FIG. 27 is a perspective view from the front and toward one side of a variation of the roll tensioner for the system of FIG. 21 wherein a stationary length of a flexible material positions and rotatably supports the roll of material to apply sliding frictional resistance at the periphery of the roll.

FIG. 27 illustrates another variation of the automatic roll tensioner 100 wherein the roll support member is a length of a flexible material 114 supported at its respective ends at shafts 115 and 116 with the length of the flexible material intermediate the supported ends forming a cradle configuration on which the roll of material 93 is supported. During unwinding, the roll is rotated relative to the stationary flexible material. The flexible material is preferably selected from the group consisting of fabric, netting, thin sheet metal and belting. In this form of the invention, the roll tensioner applies sliding frictional resistance to the periphery of the roll of material during unwinding.

While I have shown and described only several example embodiments in accordance with the present invention, it is understood that various changes and modifications can be made therein by the skilled artisan without departing from the invention. Therefore, I do not wish to be limited to specific example embodiments disclosed herein, but intend to cover such variations as are encompassed by the scope of the appended claims.

What is claimed:

1. A method of making a cushioning product comprising:

supporting a roll of material at the periphery of the roll within a cradle configuration formed by at least one roll support member of an automatic roll tensioner which permits the roll to be rotated about a longitudinal axis of the roll in response to pulling material from the roll while applying frictional resistance to rotation of the roll with the at least one roll support member to tension the material;

pulling material from the roll of material within the cradle configuration of the automatic roll tensioned with a material feeding arrangement spaced from the automatic roll tensioner to rotate the roll and tension the material unwound from the roll;

shaping the tensioned material unwound from the roll for converting the material into a cushioning product;

wherein the material being pulled from the roll and shaped is tensioned by the automatic roll tensioner by applying frictional resistance to rotation of the roll as a function of the weight of the roll at the periphery of the material on the roll to prevent material backlash when the pulling is stopped; and wherein the cradle configuration formed by the at least one roll support member has a lower narrow end and a wider, open upper end, said method including introducing the roll of material into the cradle configuration of the automatic roll tensioner through said wider, open upper end.

2. The method according to claim 1, wherein the frictional of resistance applied is rolling frictional resistance.

3. The method according to claim 1, wherein the frictional resistance applied is sliding frictional resistance.

4. The method according to claim 1, including detecting at least one marking provided on the roll for identifying a characteristic of the roll of material and adjusting an acceleration/deceleration profile of said pulling as a function of the identified characteristic.

5. The method according to claim 4, wherein the characteristic of the roll of material identified is at least one of the characteristics selected from the group consisting of:

(1) type of material;

(2) weight of the material;

(3) thickness of the material;

(4) weight of the roll of material;

(5) diameter of the roll of material;

(6) width of the roll of material;

(7) presence or absence of a core around which the material is wound; and (8) dimension and/or shape of a core around which the material is wound.

6. The method according to claim 4, including using a recognition device to detect the at least one marking provided on the roll of material.

7. The method according to claim 6, wherein the at least one marking on the roll of material which is detected is selected from the group consisting of:

(1) barcode;

(2) magnet;

(3) microchip;

(4) hologram; and (5) pattern.

8. The method according to claim 1, including tracking the amount of material used in said method.

9. The method according to claim 8, wherein said tracking includes using a recognition device to detect the at least one marking provided along the length of the roll of material.

* * * * *